US007057486B2

(12) United States Patent
Kiko

(10) Patent No.: US 7,057,486 B2
(45) Date of Patent: Jun. 6, 2006

(54) CONTROLLED INDUCTION DEVICE AND METHOD OF MANUFACTURING

(75) Inventor: Frederick J. Kiko, Carlsbad, CA (US)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 10/000,877

(22) Filed: Nov. 14, 2001

(65) Prior Publication Data

US 2004/0150500 A1 Aug. 5, 2004

(51) Int. Cl.
*H01F 17/06* (2006.01)

(52) U.S. Cl. ..... 336/178

(58) Field of Classification Search ..... 336/65, 336/83, 192, 198, 200, 220–222
See application file for complete search history.

(56) References Cited

U.S. PATENT DOCUMENTS

| | | | | |
|---|---|---|---|---|
| 1,767,715 | A | | 6/1930 | Stoekle |
| 2,913,640 | A | | 11/1959 | Edgarton |
| 3,551,864 | A | * | 12/1970 | Sweeney et al. ..... 336/83 |
| 3,585,553 | A | | 6/1971 | Muckelroy et al. |
| 4,013,911 | A | | 3/1977 | Fujiwara et al. |
| 4,047,138 | A | | 9/1977 | Steigerwald |
| 4,118,678 | A | | 10/1978 | Goshima et al. |
| 4,462,016 | A | | 7/1984 | Bland et al. |
| 4,613,841 | A | | 9/1986 | Roberts |
| 4,713,589 | A | | 12/1987 | Kashiwagi |
| 4,833,437 | A | | 5/1989 | Williamson |
| 5,003,279 | A | | 3/1991 | Morinaga et al. |
| 5,166,655 | A | | 11/1992 | Rogers |
| 5,281,942 | A | | 1/1994 | Stokes |
| 5,350,980 | A | | 9/1994 | Dye et al. |
| 5,351,167 | A | | 9/1994 | Wai et al. |
| 5,359,315 | A | | 10/1994 | Inoue et al. |
| 5,506,560 | A | * | 4/1996 | Takeuchi et al. ..... 336/83 |
| 5,670,925 | A | | 9/1997 | Gibbs |
| 5,770,991 | A | | 6/1998 | Baird |
| 5,939,955 | A | | 8/1999 | Chen et al. |
| 5,952,907 | A | | 9/1999 | McWilliams et al. |
| 6,005,467 | A | | 12/1999 | Abramov |
| 6,087,920 | A | | 7/2000 | Abramov |
| 6,091,211 | A | | 7/2000 | Koga et al. |
| 6,154,028 | A | | 11/2000 | Bushida et al. |
| 6,181,777 | B1 | | 1/2001 | Kiko |
| 6,212,259 | B1 | | 4/2001 | Kiko |
| 6,223,419 | B1 | | 5/2001 | Abramov |
| 6,326,874 | B1 | | 12/2001 | Banzi, Jr. et al. |

(Continued)

FOREIGN PATENT DOCUMENTS

JP 56-012714 * 2/1981

*Primary Examiner*—Tuyen T Nguyen
(74) *Attorney, Agent, or Firm*—Gazdzinski & Associates

(57) ABSTRACT

A dual-core inductive device having one or more core elements and a sleeve adapted to fit over the core element(s). The device is significantly less expensive to produce than prior art transformers having similar characteristics. In one exemplary embodiment, the device includes two cylindrical cores forming a first (end) gap used to adjust the device's differential inductance independent of its common mode inductance. Similarly, a second gap is provided to adjust the device's common mode (leakage) inductance independent of its differential inductance. The substantially independent control afforded by these gaps allows for devices to be designed to simultaneously meet different sets of requirements; e.g., signal-path specifications and longitudinal inductance requirements. Methods for manufacturing the device(s), and telecommunications filter and splitter circuit applications, are also disclosed.

28 Claims, 22 Drawing Sheets

U.S. PATENT DOCUMENTS 6,414,583 B1 7/2002 Yeh et al.
6,483,412 B1 11/2002 Holdahl et al.
6,512,438 B1 1/2003 Yoshimori et al.
6,560,851 B1 5/2003 Yamamoto et al.

* cited by examiner (1 OF 3)

(2 OF 3)

(3 OF 3)

CONTROLLED INDUCTION DEVICE AND METHOD OF MANUFACTURING

BACKGROUND OF THE INVENTION

1. Field of the Invention

The present invention relates generally to inductive circuit elements, and more particularly to a controllable-inductance inductor or transformer architecture and a method of manufacturing the same.

2. Description of Related Technology

As is well known in the art, inductive components are electronic devices which provide the property of inductance (i.e., storage of energy in a magnetic field) within an alternating current circuit. Inductors are one well-known type of inductive device, and are formed typically using one or more coils or windings which may or may not be wrapped around a magnetically permeable core. So-called "dual winding" inductors utilize two windings wrapped around a common core.

Transformers are another type of inductive component that are used to transfer energy from one alternating current (AC) circuit to another by magnetic coupling. Generally, transformers are formed by winding two or more wires around a ferrous core. One wire acts as a primary winding and conductively couples energy to and from a first circuit. Another wire, also wound around the core so as to be magnetically coupled with the first wire, acts as a secondary winding and conductively couples energy to and from a second circuit. AC energy applied to the primary windings causes AC energy in the secondary windings and vice versa. A transformer may be used to transform between voltage magnitudes and current magnitudes, to create a phase shift, and to transform between impedance levels.

Ferrite-cored inductors and transformers are commonly used in modern broadband telecommunications circuits to include ISDN (integrated services digital network) transceivers, DSL (digital subscriber line) modems and cable modems. These devices provide any number of functions including shielding, control of longitudinal inductance (leakage), and impedance matching and safety isolation between broadband communication devices and the communication lines to which they are connected. Ferrite-core inductive device technology is driven by the need to provide miniaturization while at the same time meeting performance specifications set by chip-set manufactures and standards bodies such as the ITU-T. For example, in DSL modems, microminiature transformers are desired that can allow a DSL signal to pass through while introducing a minimal THD (total harmonic distortion) over the DSL signal bandwidth. As another example, dual-winding inductors can be used in telephone line filters to provide shielding and high longitudinal inductance (high leakage).

A common prior art ferrite-cored inductive device is known as the EP-core device. FIG. 1*a* illustrates a prior art EP transformer arrangement, and illustrates certain aspects of the manufacturing process therefor. The EP core of the device 100 of FIG. 1*a* is formed from two EP-core half-pieces 104, 106, each having a truncated semi-circular channel 108 formed therein and a center post element 110, each also being formed from a magnetically permeable material such as a ferrous compound. As shown in FIG. 1*a*, each of the EP-core half-pieces 104, 106 are mated to form an effectively continuous magnetically permeable "shell" around the windings 112*a*, 112*b*, the latter which are wound around a spool-shaped bobbin 109 which is received on the center post element 110. The precision gap in ground on the ferrite post 110 can be engineered to adjust the transfer function of the transformer to meet certain design requirements. When the EP core device is, the windings 112*a*, 112*b* wrapped around the bobbin 10 also become wrapped around the center post element 110. This causes magnetic flux to flow through the EP core pieces when an alternating current is applied to the windings. Once the device is assembled, the outer portion 21 of the EP cores 20 self-enclose the windings to provide a high degree of magnetic shielding. The ferrous material in the core is engineered to provide a given flux density over a specified frequency range and temperature range.

When completely assembled, the device 100 is mounted on top of a terminal array 114 generally with the windings 112*a*, 112*b* (i.e., the truncated portions 116 of the half-pieces 104, 106) being adjacent to the terminal array 114, which is subsequently mated to the printed circuit board (PCB) when the device 100 is surface mounted as shown in FIG. 1*a*. Note that the truncated portions are present, inter alia, to allow termination of the windings 112 outside of the device 100. Margin tape 117 may be applied atop the outer portions of the outer winding 112*b* for additional electrical separation if desired. FIG. 1*b* illustrates a surface mount implementation of the EP transformer mounted onto a circuit board.

Magnet wire is commonly used to wind transformers and inductive devices (such as inductors and transformers, including the aforementioned EP-type device). Magnet wire is made of copper or other conductive material coated by a thin polymer insulating film or a combination of polymer films such as polyurethane, polyester, polyimide (aka "Kapton™"), and the like. The thickness and the composition of the film coating determine the dielectric strength capability of the wire. Magnet wire in the range of 31 to 42 AWG is most commonly used in microelectronic transformer applications, although other sizes may be used in certain applications.

FIG. 1*c* illustrates a cross-section of the prior art device 100 after assembly.

Prior art EP inductive devices have several other shortcomings. A major difficulty with EP devices is the complexity of their manufacturing process, which gives rise to a higher cost. Also, the EP core half pieces themselves are relatively costly to mold and produce. For example, by the time the EP transformer is assembled and tested, its volume production cost is high (currently ranging from approximately \$0.5;0 to –\$0.70). It would be desirable to produce a device having performance characteristics at least equivalent to those of an EP transformer, but at a significantly lower cost.

The shielding of prior art EP core devices is also less than optimal, due ill large part to the shielding not being uniform around the device (i.e., magnetic flux permeating the "open" lower portion of the device).

Another disadvantage to prior art EP core inductors and transformers is the inability to individually control both the leakage inductance and the differential inductance of the transformer. The leakage inductance, also known as the common mode inductance, involves the inductive coupling loss between the transformer's windings. Control of the leakage inductance is important to many telecommunication applications. For example, the FCC imposes on-hook impedance limitations on circuits interfacing to telephone lines. The ETSI Specification requires a minimal "longitudinal impedance" (such as 10 KOhm) depending on frequency from each of tip and ring to ground. "Tip" and "ring" correspond to the two wires of a two-wire current loop as provided on a copper telephone wire. When designing with an EP transformers and inductors, in order to meet ETSI specifications, a second transformer is typically needed so that a pair of transformers is able to meet both a signal path transfer function requirement and a longitudinal inductance requirement. This can be very costly since the total DC resistance budget often requires all of the transformers to be larger to reduce the DC resistance of each transformer. The larger transformers are more expensive, physically consume more space, and have more parasitic capacitance. The increased parasitic capacitance results in lower bandwidth. It would be desirable to have a transformer that has a controllable common mode inductance so that the second transformer could be eliminated. This would provide smaller, less expensive transformer solutions that also have reduced parasitic capacitances and improved signal path frequency responses.

The main inductance of concern in a transformer is its differential inductance. The differential inductance is the inductance measured with the winding in series. While techniques to control the leakage inductance exist in EP transformers, an adjustment made to control of the differential inductance tends to have little effect on the leakage inductance. This lack of the ability to separately control the leakage inductances gives rise for the aforementioned need for two transformers to provide a transformer-system solution that meets both the signal path specification and the longitudinal inductance specification. It would be desirable to have a transformer architecture that could provide even partially independent control of both the differential and leakage inductances.

Based on the foregoing, it would be most desirable to provide an improved inductive component, related telecommunication circuits, and a method of manufacturing the improved inductive component. Such an improved device would involve a lower cost manufacturing process using inexpensive components to produce devices at a lower cost. It would also be advantageous if such a device could have independently controllable differential and leakage inductances to eliminate the need for a second device to control the leakage inductance as would otherwise be needed to satisfy a system-level longitudinal inductance specification. The elimination of the second device would further reduce costs at the system level and reduce the overall DC resistance, parasitic capacitance and footprint of the component. It would also be desirable for such an improved device to maintain desirable characteristics attributed to EP core devices such as small size, wideband performance, low THD, and also possess a high degree of electromagnetic shielding. Such an improved device could also be utilized in filter and splitter circuits to provide enhanced performance at lower cost that existing prior art solutions.

SUMMARY OF THE INVENTION

The present invention satisfies the aforementioned needs by providing an improved inductive device, and method of manufacturing the same.

In a first aspect of the invention, a shielded core assembly for use in an inductive device is disclosed. In one embodiment, the assembly comprises a first core and a second core, at least a portion of the cores comprising a magnetically permeable material and adapted to receive a first and second winding thereon, respectively; and a sleeve, at least a portion of the sleeve comprising a magnetically permeable material, the sleeve further being adapted to fit over at least a portion of the aforementioned cores and magnetically shield at least a portion of the windings and cores.

In a second aspect of the invention, a selectively controllable inductive core assembly for use in an inductive device is disclosed. In one embodiment, the assembly comprises a first core and a second core, at least a portion of the cores comprising a magnetically permeable material; and a sleeve, at least a portion of the sleeve comprising a magnetically permeable material, the sleeve further being adapted to fit over at least a portion of the cores. The first and second cores cooperate with the sleeve to form first and second side gaps when said core assembly is assembled. The side gaps are used to control the leakage (common mode) inductance of the device. Additionally, the first and second cores cooperate to form at least one end gap therebetween when the device is assembled, the end gap(s) being used to control the differential inductance of the device. Advantageously, the use of the foregoing gaps allows somewhat independent control of the common mode and differential inductances In a third aspect of the invention, an improved dual-core inductive device is disclosed. In one embodiment, the device comprises a transformer incorporating the shielding and selectively controllable inductance features of the aforementioned core assemblies, and further includes first and second conductive windings wound upon the first and second cores, respectively. The first winding comprises a transformer primary, and the second a transformer secondary, thereby providing voltage transformation with independently controlled common mode and differential inductance and magnetic shielding within a unitary device. In another embodiment, the device comprises an isolation transformer having four windings (two per core) wound either in bifilar or layer fashion, thereby providing a low cost isolation transformer with independently controlled common mode and differential inductance, and suitable for applications such as DSL. In another application, the device comprises four windings (two per core), and is useful for DC/DC converter applications with dual drive and dual current limited outputs.

In a fourth aspect of the invention, an improved single core inductive device is disclosed. In one exemplary embodiment, the device comprises a single core fitted within a closed-end sleeve. The side and end gaps created between the outer periphery and the end surface of the core, respectively, and the sleeve are controlled to control the common mode and differential inductances of the device. In one variant, an electrically balanced device is provided through use of bifilar windings on the core, the two bifilar windings having matched inductance and resistance. In a second variant, an unbalanced device is produced through use of two separate layered windings which have independently controllable inductance and resistance.

In a fifth aspect of the invention, a circuit board assembly comprising a substrate (e.g., PCB) having a plurality of conductive traces and one or more of the aforementioned inductive devices mounted thereon. A terminal array comprising a plurality of electrically conductive terminals electrically interfaces the inductive device with the traces of the substrate.

In a sixth aspect of the invention, a circuit utilizing one or more of the he aforementioned inductive devices is disclosed. In one embodiment, the circuit comprises a DSL splitter circuit having one dual-core inductive device and two single-core inductive devices as described above. This configuration provides superior signal splitting performance at extremely low cost. In another embodiment, a T1E1-compliant filter circuit is disclosed. In one variant of the filter circuit, a dual-core inductor and dual-winding, single core inductor are used in series between the line and extension device (e.g., POTS telephone). In another variant of the filter, two separate standard drum core inductors are used in series with a dual winding, single core inductor.

In a seventh aspect of the invention, a method of manufacturing an inductive component is disclosed. In one exemplary embodiment, the method comprises determining one or more values of a first set of design parameters that cause the inductive component to meet a first set of specifications; determining one or more values of a second set of design parameters that cause the inductive component to meet one or more second specifications, the second set of parameters containing at least one parameter that can be adjusted to modify an inductance (e.g., longitudinal inductance) of the inductive component without requiring at least some of the values of the first set of parameters to be readjusted to maintain the first specification; and manufacturing the inductive component in accordance with the first and second sets of design parameters. In one particular variant, the method is adapted to a dual-core device and comprises: providing a quantity of cores; providing a quantity of sleeves; providing a quantity of wire; producing at least one sample dual-core inductive device by respectively wrapping a first and a second winding around first and second cores in accordance with a nominal turns number; arranging the first and second wound cores within a sleeve; electrically testing at least one inductive property of the sample(s); determining the production turns that produces a desired inductive property of the device; and producing a plurality of dual-core inductive devices in batches in accordance with the production turns.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Reference is now made to the drawings wherein like numerals refer to like parts throughout.

Figure 2A:
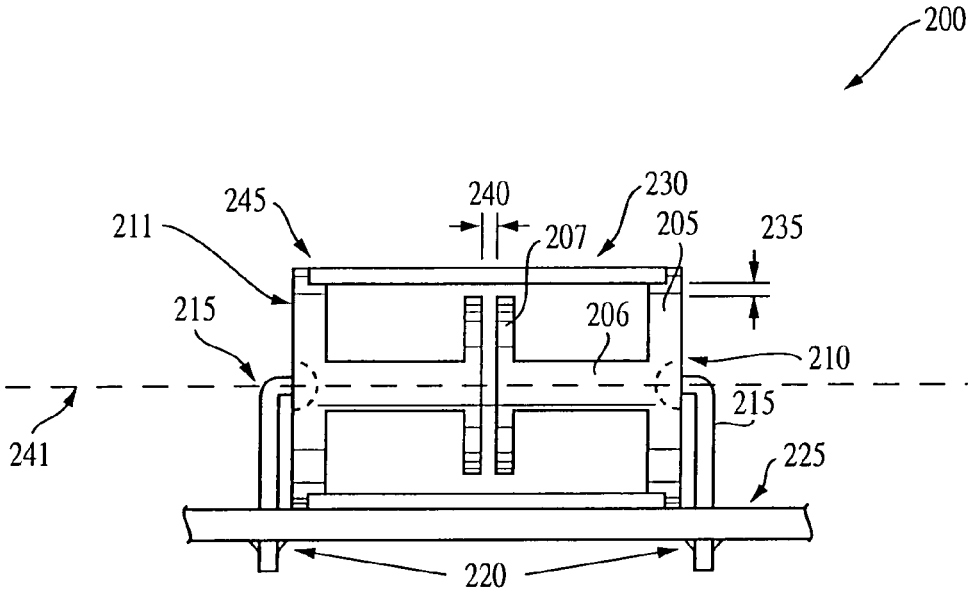
FIGS. 2*a* and 2*b* are side cross-sectional and end plan views, respectively, of a first exemplary embodiment of a dual-drum-core transformer device according to the present invention.

Referring now to FIG. 2*a*, an exemplary embodiment of a dual-drum-core inductive device (e.g., transformer) 200 is described. It will be recognized that while the following discussion is cast in terms of a dual core transformer, the invention is equally applicable to other inductive devices (e.g., inductors).

Figure 2B:
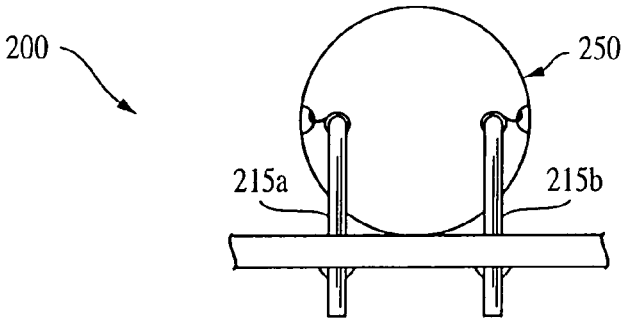
Figure 2C:
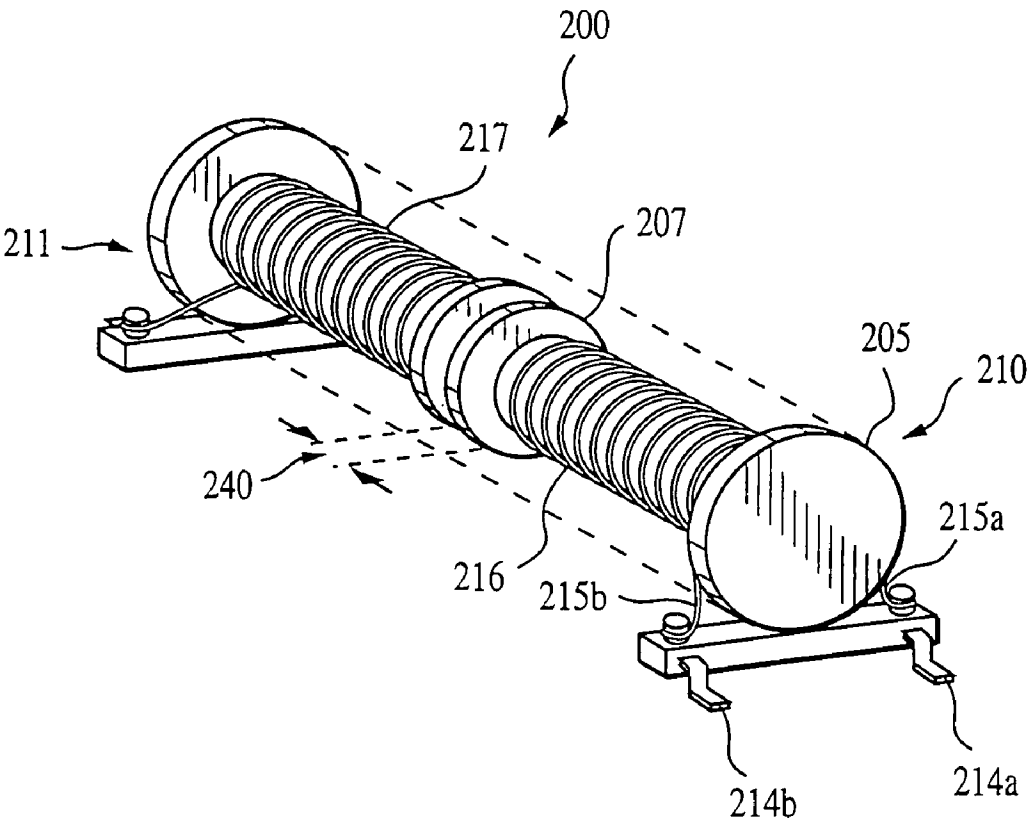
FIG. 2*c* is a perspective view of a second embodiment of the dual-drum-core transformer (with sleeve removed), having a terminal array adapted for surface mounting.

FIG. 2*a* shows a cross sectional side view of the illustrative embodiment while FIG. 2*b* shows an end view of the same. FIG. 2*c* shows a perspective view of the transformer 200 with the outer sleeve component removed so as to illustrate the internal components of the device. As shown in FIGS. 2*a*–2*b*, the device 200 generally comprises a pair of modified ferrite cores 210, 211 (also called bobbin cores) which, in the illustrated embodiment, are cylindrical drum-shaped ("drum cores"), although cores of other configurations and cross-sections may be used. As shown in FIG. 2*b*, the transformer appears as a horizontal cylinder having two leads, 215*a* and 215*b* on either side of the cylinder. The two leads correspond to the single winding used on each core of the present embodiment; however, as described in greater detail below, multiple windings per core may be used, thereby necessitating additional sets of leads.

The two leads 215*a* and 215*b* of the embodiment of FIGS. 2*a*–2*b* appear as a single lead 215 in the side view of FIG. 2*a*. The leads 215*a* and 215*b* are used for affixing to a circuit board 225 via a solder point 220. The leads 215*a* and 215*b* can protrude from or be otherwise coupled to the bobbin 210 is various ways.

In one configuration, the leads 215*a*, 215*b* are coupled directly from the bobbin 210 and formed as surface mount (SMT) leads, thereby providing the advantage of low cost. In another configuration, as illustrated in FIG. 2*c*, instead of protruding from the center of the bobbin 210, the leads 215*a* and 215*b* can be mounted into a base 212 for surface mount connection. In the embodiment of FIG. 2*c*, the leads 215*a* and 215*b* are respectively electrically coupled to a set of surface mount leads 214*a* and 214*b*. The leads 215*a* and 215*b* are connected to the ends of a winding 216. The exact placement of the leads 215*a* and 215*b* can be optimized based upon circuit placement and mounting considerations at the system level. The placement of the leads is flexible because the leads connect to a wire that wraps around the bobbin 210 to form the winding 216. The leads may also be notched to facilitate wire-wrapping as is well known in the electronic arts. Also, while the terminals 214*a* and 214*b* of FIG. 2*c* comprise the well known "L" shape adapted for surface mounting to a substrate, it will be recognized that other pin configurations may conceivably be used as well, including balls (such as in the well known ball grid array approaches) or pins (such as used in pin grid arrays; see FIG. 2*a*).

In the illustrative embodiment of FIGS. 2*a* and 2*b*, the transformer appears as a horizontal cylinder that has a circular sleeve 230, 250. While a circular sleeve is desirable in some embodiments (due largely to low cost), the sleeve may take on other cross sectional shapes. For example, it may be desirable to use a square cross section in order to provide a rectangular box-shaped component. Other cross sections such as oval, polygon, rectangle, and the like can be implemented as well. Similarly, the bobbins 210, 211 can be implemented with first cross section (such as circular) and enclosed by an encasing (not shown) having a second cross section. For example, a transformer having a circular bobbin and sleeve can be encased in a by a box-shaped encasing to provide an exterior box-like profile. Embodiments with encasings may be desirable for use with automated machine circuit mounting equipment. Also, the exterior casing may provide additional electromagnetic shielding. All such embodiments are contemplated variations of the illustrative embodiment 200.

In the exemplary embodiment of FIG. 2*a*, the bobbins 210 and 211 have effectively identical shape. However, transformer embodiments whereby the bobbins 210 and 211 have different shapes are also contemplated by the present invention. This provides a degree of freedom that may be useful when designing a transformer to meet a set of design specifications. For the purpose of illustration only, the bobbins 210 and 211 are assumed to have identical geometries. Therefore, the discussion below of the bobbin 210 applies similarly to the bobbin 211.

The bobbin 210 is fashioned from a magnetically permeable material such as a soft ferrite or powdered iron, as is well known in the electrical arts. The manufacture and composition of such cores is well understood, and accordingly not described further herein. Presently, drum-shaped bobbins can be mass produced inexpensively and are available at a very low cost (on the order of $0.05 per unit in mass quantities). The bobbin 210 has a first flange 205 and a second flange 207. While it is common practice to produce bobbins whose flanges 205, 207 are equal in diameter, for use with the present invention, the first flange 205 typically has a larger diameter than the second flange 207. A bobbin that has the first flange 205 with a diameter substantially larger or smaller than the second flange 207 is referred to as an "asymmetric bobbin" or an "asymmetric drum core."

As shown in FIG. 2*a*, the sleeve 230 forms a right-angle joint 245 with the bobbins 210 and 211. The right-angle joint 245 is preferably butted into the bobbin 211 so as to create a minimum sized (negligible) gap between the sleeve 230 and each of the bobbins 210 and 211. A smaller gap between the sleeve 230 and each of the bobbins 210 and 211 advantageously results in a smaller amount of magnetic cross talk from one transformer to another. In such embodiments, the right-angle joint 245 may involve angles other than ninety degrees. In the preferred embodiment, though, the joint 245 is illustratively a right-angle joint.

The distance from the inner surface of the sleeve 230 to the top of the second flange 207 defines a side (air) gap 235. When the second flange 207 of the bobbin 210 is positioned with respect to the corresponding flange of the other bobbin 211 to within a non-zero spacing, an end (air) gap 240 also results as shown in FIG. 2*a*.

To construct a transformer with a specific set of electrical characteristics, certain parameters must be considered. A first parameter is the turns ratio. The turns ratio is commonly defined as the ratio of the number of turns in the primary winding 216 divided by the number of turns in the secondary winding 217. Another parameter of interest is the dielectric strength of the conductor insulation. Magnet wire of the type previously described is generally suitable to meet the insulation requirement within the windings 216, 217. Other types of insulated wire with different dielectric strengths could be used as well. It will be apparent to those of ordinary skill in the polymer chemistry arts that any number of different insulating compounds may be used in the present application. A Parylene coating as is commonly used as a coating on magnet wire is selected in the present embodiment. Parylene is chosen for its superior properties and low cost; however, certain applications may dictate the use of other insulating materials. Such materials may be polymers such as for example fluoropolymers (e.g., Teflon, Tefzel), polyethylenes (e.g., XLPE), polyvinylchlorides (PVCs), or conceivably even elastomers. Additionally, mylar or other insulating tape (or even dip or spray-on coatings) may be used to separate layers of windings and/or provide an outer protective cover for the windings.

Yet another set of parameters involve the physical dimensions and makeup of the transformer itself. The material properties of the bobbins 210 and 211 influence linear and nonlinear transfer characteristics that may affect the frequency response, mutual inductance and THD (total harmonic distortion) of the transformer. Other bobbin parameters include the cross section shape, spool diameter 206, and diameters of the flange 205, 207. The horizontal length of the sleeve 230 impacts the transformer's transfer characteristic and also defines the end air gap 240 once the bobbin parameters have been fixed. It should be noted that the transfer function of the transformer can be dependent on all of these parameters, and a given mix of parameters can be selected to provide a transformer with a given shape and having a specified transfer characteristic.

Another important parameter of the present invention is the length of the side air gap 235. It has been discovered that, once all the other parameters have been fixed, the magnitude of the side air gap 235 somewhat independently influences the leakage inductance of the transformer. Leakage inductance, also called the "common mode inductance," for balanced filters represents the inductance between the primary and secondary windings, and this inductance appears in series with the windings. The leakage inductance may be adjusted in order to meet a longitudinal impedance specification with which the device must comply. By adjusting the magnitude of the side air gap 235, the leakage inductance can be directly controlled without the need for a second transformer as is commonly using prior art EP-core based transformers. The ability to independently control the leakage inductance of the dual-core transformer 200 of FIG. 2*a* by setting an appropriate side air gap 235 is a key advantage of the present invention.

Figure 1A:
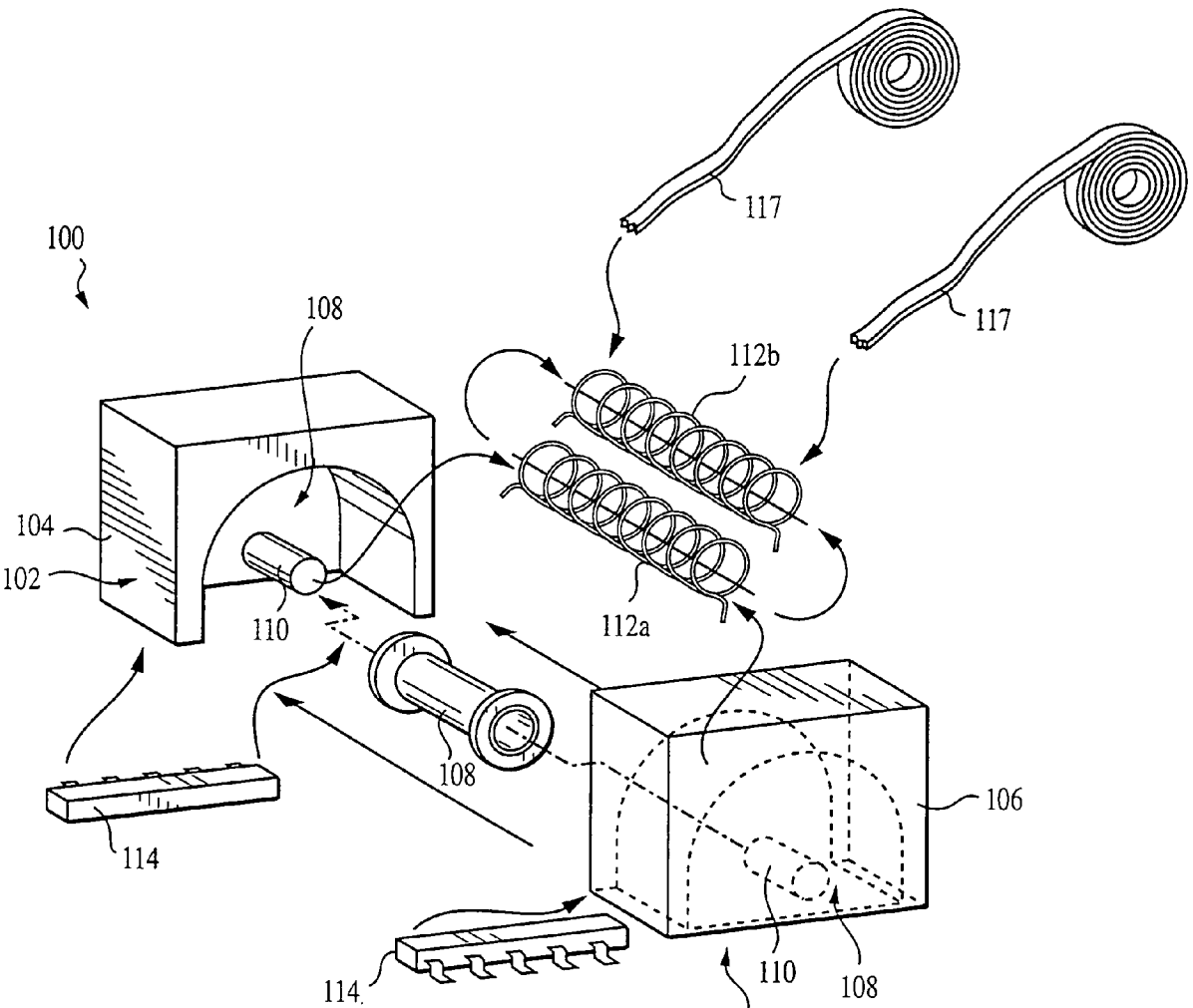
FIG. 1a (PRIOR ART)
FIG. 1*a* is an exploded view of a typical prior art EP transformer design having a two-piece EP core, illustrating the components and manufacturing requirements thereof.
Figure 1B:
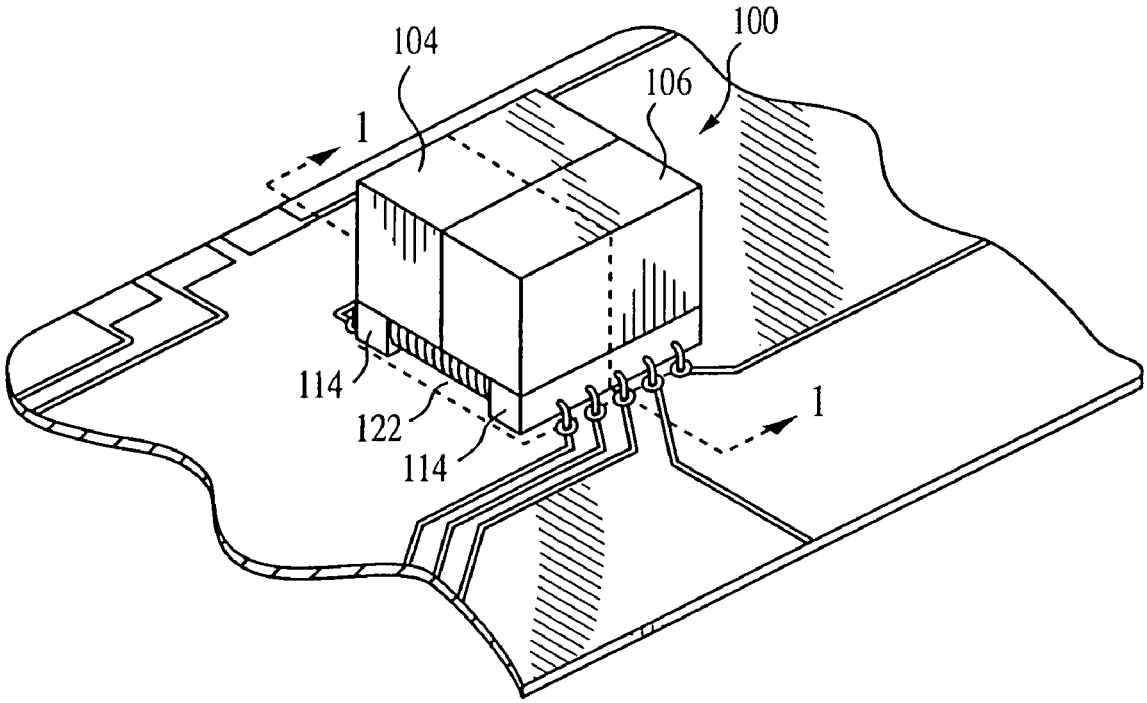
FIG. 1b (PRIOR ART)
FIG. 1*b* is a perspective view of the prior art transformer of FIG. 1*a* after assembly and mounting on a substrate.
Figure 1C:
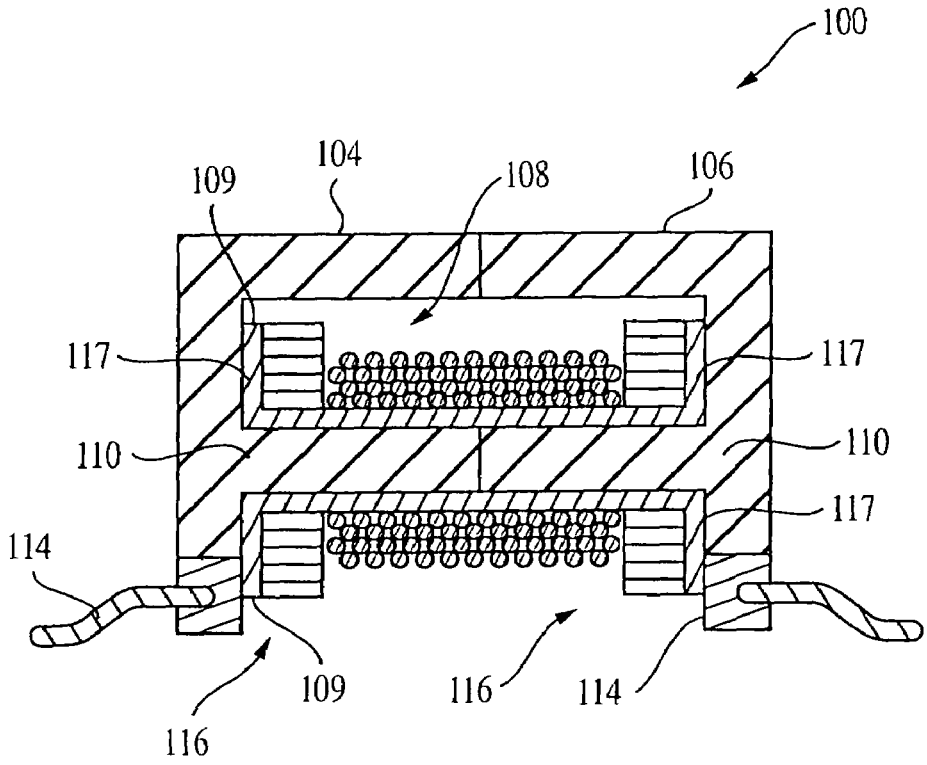
FIG. 1c (PRIOR ART)
FIG. 1*c* is a cross-sectional view of the assembled transformer of FIG. 1*a* taken along line 1—1, illustrating the relationship of the various components.

Still another important parameter of the present invention is the size or magnitude of the end air gap 240. It has been discovered that, once all the other parameters have been fixed, the size of the end air gap 240 influences (in substantial part independent of the side gap) the differential inductance of the transformer. This decoupling of the control over the leakage inductance and the differential inductance advantageously allows transformers to be designed to simultaneously conform to both a signal path transfer function specification and also a longitudinal impedance requirement. In prior art transformers such as the EP-core transformer of FIG. 1, an adjustment made to modify the differential inductance would also influence the leakage inductance. This deficiency caused system level solutions involving two or more transformers to be required to meet both the signal path transfer function requirement and the longitudinal impedance requirement. The present invention substantially overcomes this difficulty and thereby enables reduced cost transformer subsystems to be implemented.

Note that if desired, the foregoing end and side gaps 235, 240 may be optionally filled, either completely or in part, with a filler material (not shown) in order to further control inductance or other properties of the device 200. Hence, the present invention contemplates both unfilled (e.g. air) gaps and filled gaps. Such filler material may be for example a polymer, ceramic, or even a tape, and have magnetic permeability or reluctance comparable to that of the sleeve or drum core(s), or alternatively have substantially different permeability/reluctance. The use of such fillers to control inductance and other physical parameters of a transformer/inductive device are well known in the electronic arts, and accordingly not described further herein.

Figure 2D:
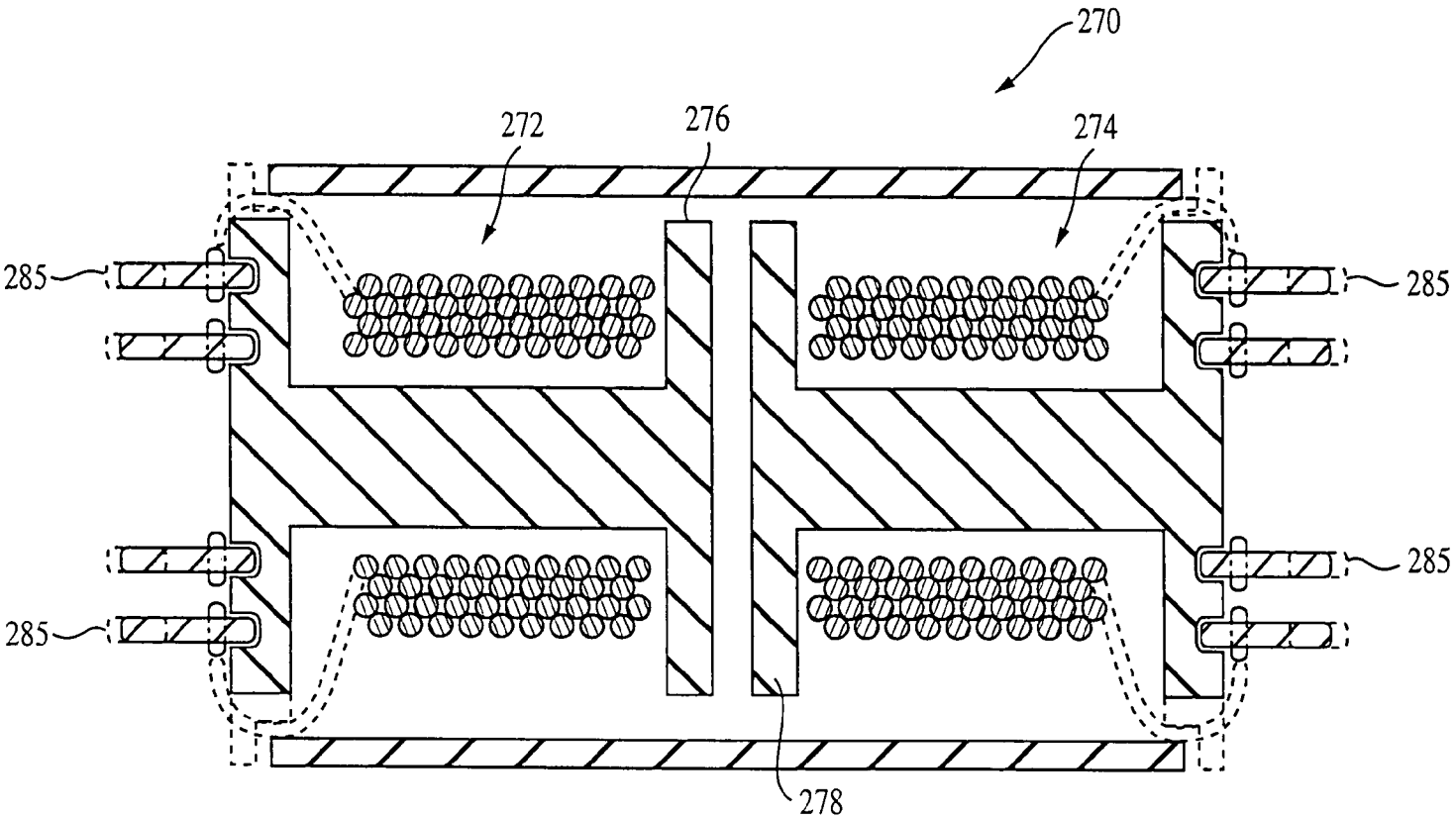
FIG. 2*d* is a top cross-sectional view of yet another embodiment of the dual core inductive device of the invention, configured as a quad-winding, quad-terminal isolation transformer.
Figure 2E:
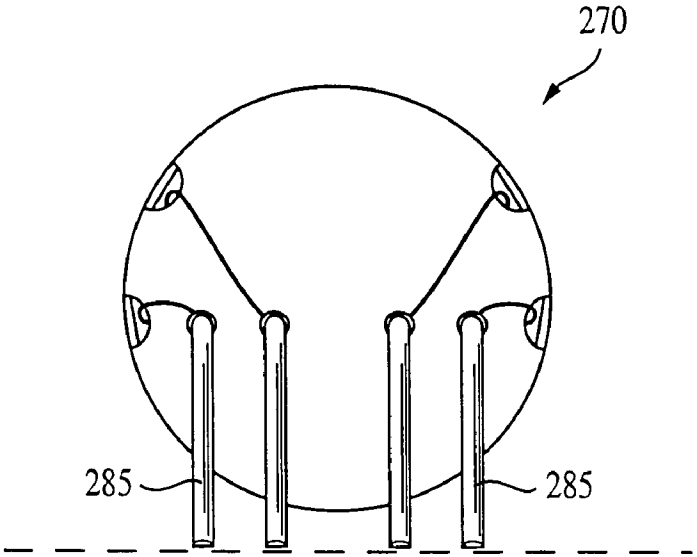
FIG. 2*e* is an end plan view of the isolation transformer device of FIG. 2*d*.
Figure 2G:
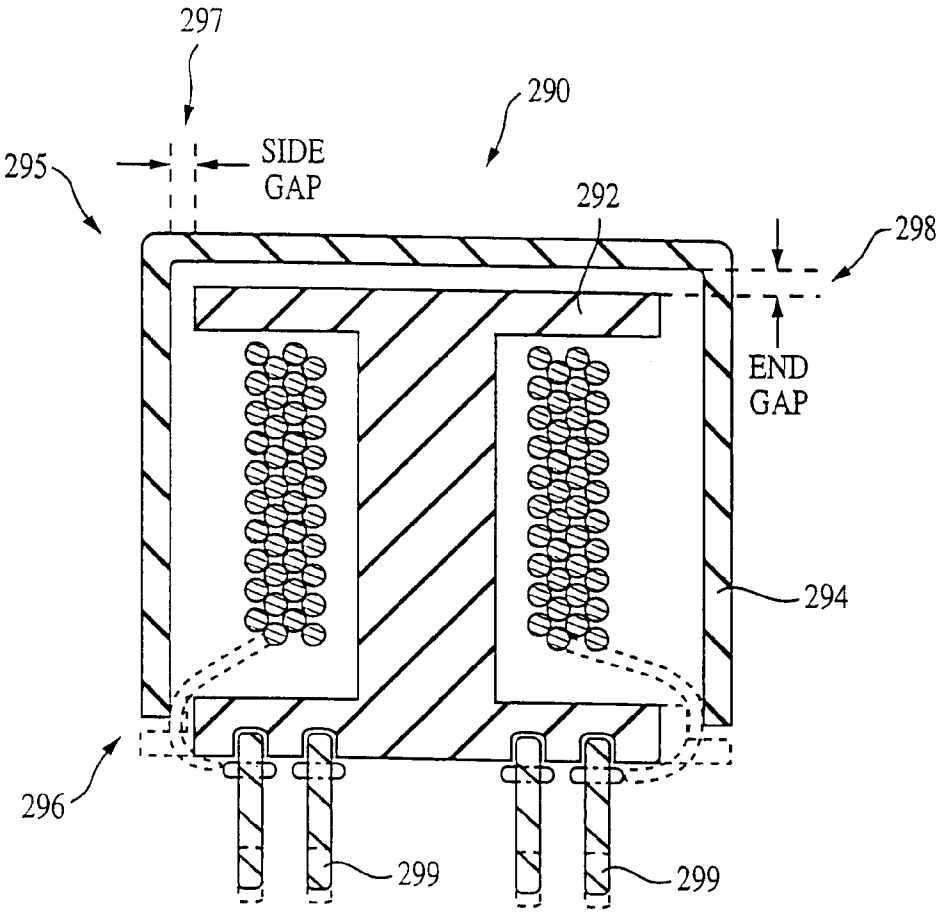
FIG. 2*g* is top cross-sectional view of yet another embodiment of the present device, comprising a single core and closed-end sleeve.
Figure 2F:
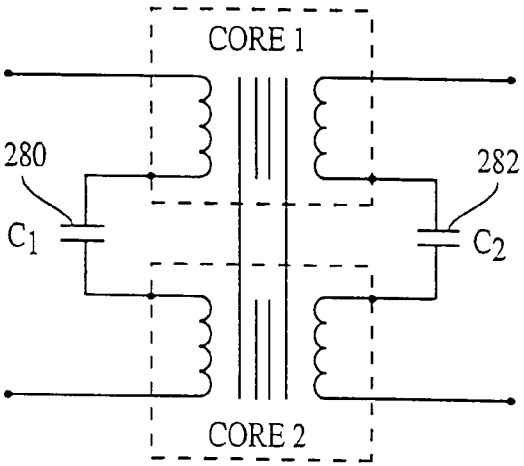
FIG. 2*f* is a schematic of the isolation transformer device of FIG. 2*d*.

Referring now to FIGS. 2*d*–2*f*, yet another embodiment of the dual core inductive device of the invention, configured as a quad-winding, quad-terminal isolation transformer, is described. As shown in FIG. 2*d*, the device 270 is generally similar in design to that of FIGS. 2*a*–2*c* discussed above, except that the device 270 of FIG. 2*d* includes two sets of windings 272, 274 (i.e., two windings per core, for a total of four windings in the device), as best shown in the schematic of FIG. 2*f* Specifically, the first set of windings 272 is disposed on the first core 276, while the second set of windings 274 is disposed on the second core 278. Respective capacitors 280, 282 are disposed between the sets of windings as shown in FIG. 2*f*, thereby providing a high-pass isolation transformer. Four terminals 285 are provided on each end of the device as shown in FIG. 2*e*.

The device of FIG. 2*d* is also outfitted with "dimple" external terminals; specifically, a dimple or recess 271 is formed within the outer surface of the cores 276, 278, into which a conductive terminal 285 is attached (e.g., glued or otherwise bonded). A notch 281 is also formed in the associated core 276, 278 proximate the terminal such that the respective winding from the core can be routed through the notch and bonded to its terminal 285, such as by wire-wrapping, soldering, etc. It will be appreciated, however, that other types of terminal mounting may be used, such as for example perforating the outer flanges of the cores through their thickness to receive the terminals directly therein. As yet another alternative, a "slot and tab" arrangement such as that described below with respect to FIGS. 3*c*–3*e* may be utilized.

The sets of windings 272, 274 of the device 270 in FIG. 2*d* may be either bifilar wound, or alternatively wound in layers as is well known in the art, but are generally wound "mirror imaged" with respect to the other core. The foregoing arrangement provides inductive coupling between the individual coils of the respective sets of windings, and to a lesser degree between the two sets of windings. Hence, the device 270 (with capacitors) effectively comprises two two-winding transformers in a balanced configuration with a high-pass characteristic.

FIG. 2*g* illustrates yet another embodiment of the inductive device, the device 290 comprising a single core 292 and closed-end sleeve or cup 294. In this device 290, the ferrous sleeve is closed off at a first end 295, while the other end 296 is open to receive the core 292 as previously described with respect to the device of FIGS. 2*a*–2*c*. The side gap 297 and end gap 298 of the inductive device 290 are essentially the same gap in the illustrated embodiment. Four terminals 299 are provided to support the two windings utilized in the device (not shown).

In one variant, the two windings are wound onto the core 292 in bifilar fashion, thereby providing balanced inductance and resistance values for the two windings. This approach provided maximum economy, since the bifilar winding ensures the desired balanced electrical properties without need for precise measurements of component parameters.

In another variant, the windings are would in layers, the lay (and length) of each winding determining the relationship between the inductance and resistance values of each individual winding. The windings may also be separated by insulating tape or coatings if desired. This approach imparts more cost to the device, but allows for selective control of the electrical properties associated with each winding. This variant reduces the inter-winding capacitance at the expense of matching; accordingly, the device could advantageously be used in applications such as low-cost isolated DC/DC converters, for example.

Figure 2H:
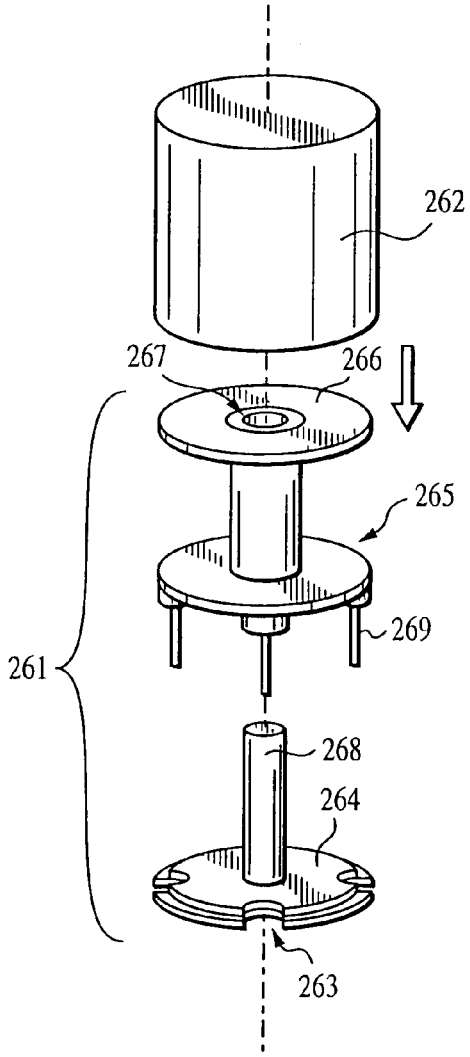
FIGS. 2*h*–2*m* are various plan and perspective views of yet another embodiment of the "single" core inductive device of the present invention, illustrating the features thereof.
Figure 2I:
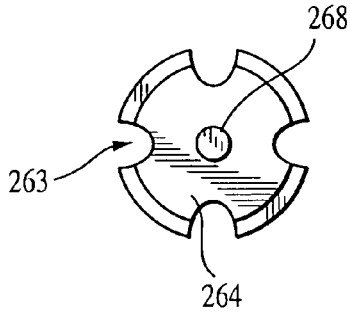
Figure 2J:
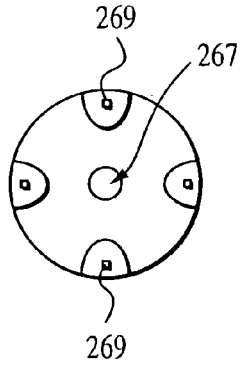
Figure 2K:
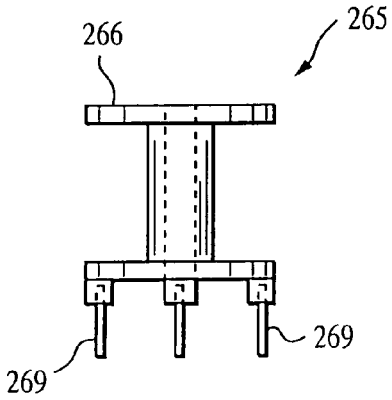
Figure 2L:
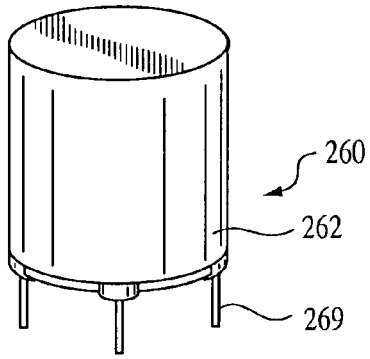
Figure 2M:
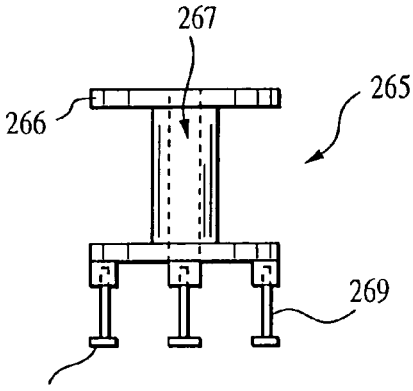

Referring now to FIGS. 2*h*–2*m*, yet another embodiment of the inductive device of the present invention is described. In this embodiment, the device 260 comprises a "single" core 261 and ferrite cup (sleeve) 262 of the type previously described herein with respect to the earlier embodiments; however, the core 261 of the present device 260 includes (i) a plurality of cut-out portions or recesses 263 formed therein at a plurality of locations on the lower flange 264 of the core base (FIG. 2*i*); and (ii) a secondary bobbin assembly 265 which fits atop the core 261 as shown in FIG. 2*h*. The secondary bobbin assembly 265 (FIG. 2*k*) includes the bobbin upper flange 266 and a central aperture 267 formed therein, the latter configured so as to form an end gap with the ferrite cup 262, and the latter to receive the central post 268 of the core 261. In the illustrated embodiment, the bobbin assembly 265 is fabricated from a low-cost plastic or other polymer, although it will be appreciated that other materials may be used. A plurality of terminals 269 are also received within the base of the bobbin assembly 265 (FIG. 2*j*) to correspond with the recesses 263 formed in the core 261, thereby allowing the terminals 269 to project downward below the plane of the lower flange 264 when the bobbin assembly 265 is mated with the core 261. Similarly, when the two components are mated, the top surface of the central post 268 forms an air gap with the top surface of the core upper flange 266. Hence, the core 261 and bobbin assembly 265 effectively form a single magnetically permeable core and bobbin comparable in performance to those previously described herein when the two components are assembled.

When the inductive device 260 is completely assembled (FIG. 21), the bobbin assembly 265 is almost completely enclosed within the ferrite cup 262, the latter sitting atop and mating with the lower flange 264, the terminals 269 protruding below the lower flange 264 so as to facilitate mating with an external device such as a PCB (not shown). The terminals 269 may be of substantially square cross-section as in the illustrated embodiment, or may be rectangular, circular, oval, or any other shape desired. Strip-type terminals (i.e., of the type commonly used on lead frames associated with surface mount packages) may also be used with equal success. Similarly, the ends of the terminals may be adapted for pin/through-hole mounting in the external device, or alternatively for surface mounting using terminals appropriately adapted for such purpose (see, for example, the flanged terminals 269 of FIG. 2*m*). It will be recognized that any number of different terminal configurations and/or mounting techniques may be employed consistent with the invention, all such configurations and techniques being well known to those of ordinary skill.

The terminals are, in the illustrated embodiment, frictionally received within corresponding apertures formed in the risers formed on the bottom surface of the lower flange of the bobbin assembly 265. Alternatively, the terminals 269 may be molded directly, glued, or even heat staked into the bobbin assembly 265.

The device windings (not shown) are, as in previous embodiments, routed through the recesses 263 of the core 261 to the terminals 269 on the underside of the device 260. Alternatively, the terminals 269 may be made to protrude through the bottom flange of the bobbin assembly 265 (not shown) such that the windings may be terminated to the terminals 269 within the interior of the device. Termination of the windings may be accomplished using solder bonding, wire wrapping (using notched terminals if desired), or any other acceptable method.

Figure 3A:
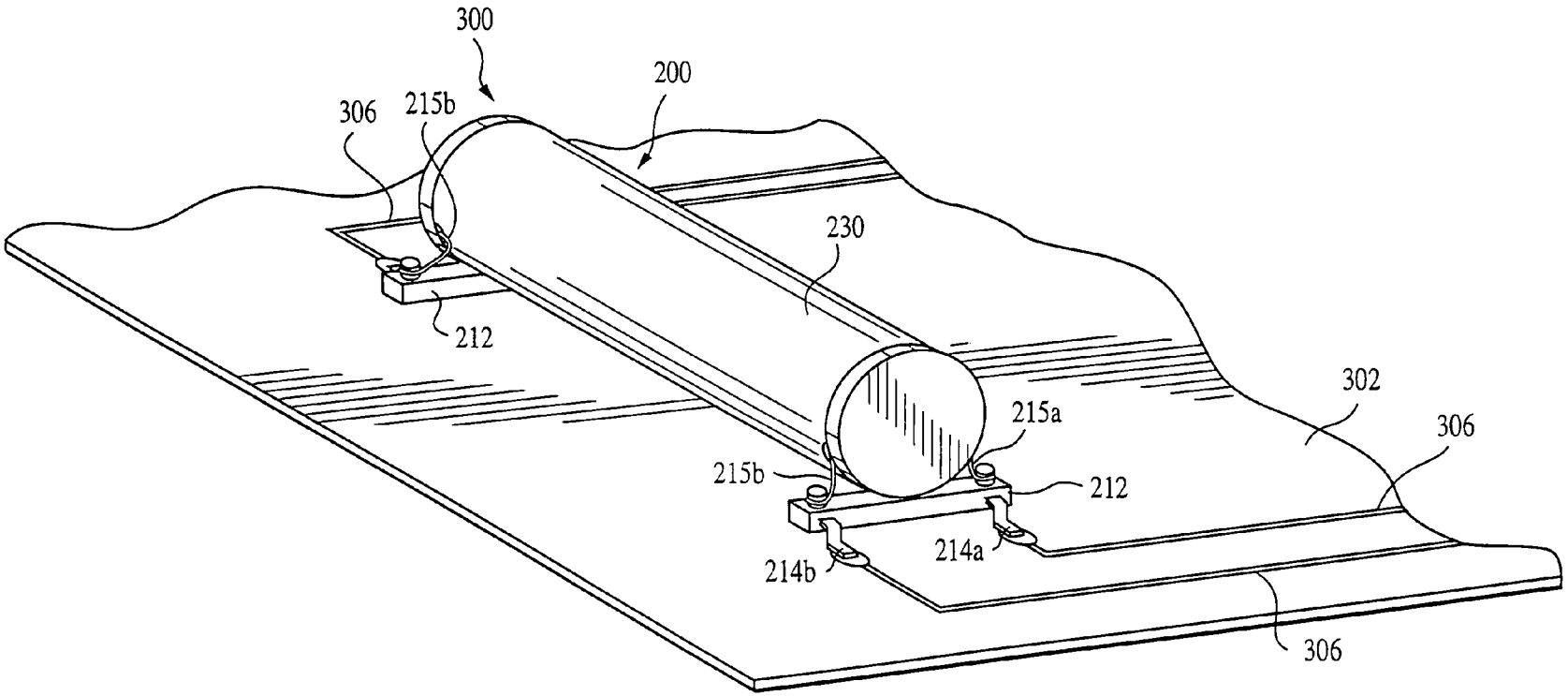
FIG. 3*a* is a perspective view of the dual core device of FIG. 2*c*, shown mounted on a substrate (PCB).

Referring now to FIG. 3*a*, the exemplary transformer 200 of FIG. 2*c* is shown mounted to an external or host device, in this case a printed circuit board (PCB). It will be appreciated that while FIG. 3 illustrates a transformer device mounted on the PCB, the inductors of FIGS. 2*d*–2*m* may be similarly mounted, consistent with their specific configuration(s).

As can be seen from FIG. 3*a*, the cylindrical transformer device 200 is mounted onto a base 212 having the leads 214*a* and 214*b* adapted for surface mounting to the printed circuit board 302. On the circuit board 302 are formed or etched traces 306 to couple the transformer 200 to other circuit elements such as discrete components (e.g., inductors, resistors, capacitors) or a DSL modem chip set. As previously discussed, the sleeve and bobbins can be designed to have non-circular cross sections if desired.

Figure 3B:
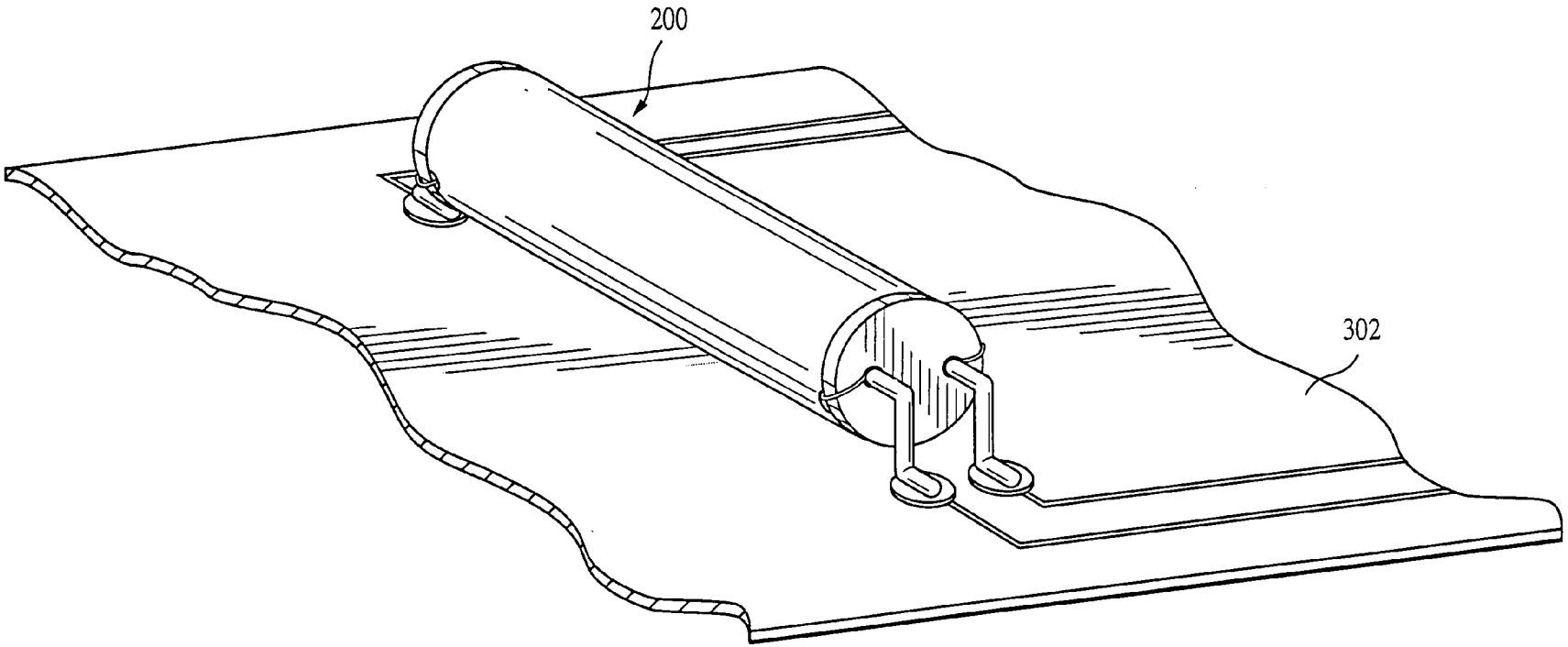
FIG. 3*b* is a perspective view of the inductive device of FIGS. 2*a*–2*b*, adapted for surface mounting on a PCB.

As yet another alternative, the terminals of the inductive device may be adapted for direct surface mounting to the PCB (i.e., without the base terminal array), as shown in FIG. 3*b*.

In the embodiments of FIGS. 3*a* and 3*b*, the device 200 is mounted to the conductive pads of the PCB using a surface mount technique involving reflow soldering of the terminals of the array (or device) to the pads, although other bonding techniques may be used. A standard eutectic solder (such as 63% lead and 37% tin) is used to establish a permanent bond between the terminals of the array (or device) and the pads of the board, although other bonding agents may be used. The device may also be mounted on the PCB using a component carrier or secondary substrate (not shown) if desired, as is also well known in the art. Furthermore, it will be recognized that other types of mounting arrangements may be utilized, such as those having a substrate with perforations through its thickness for receiving the terminal pins of the device therein (commonly referred to as a pin-grid array or PGA), such terminals subsequently being bonded using a wave or dip solder process (such as previously illustrated in FIG. 2*a*). Many other arrangements are possible, all being considered to be within the scope of the invention disclosed herein.

Figure 3D:
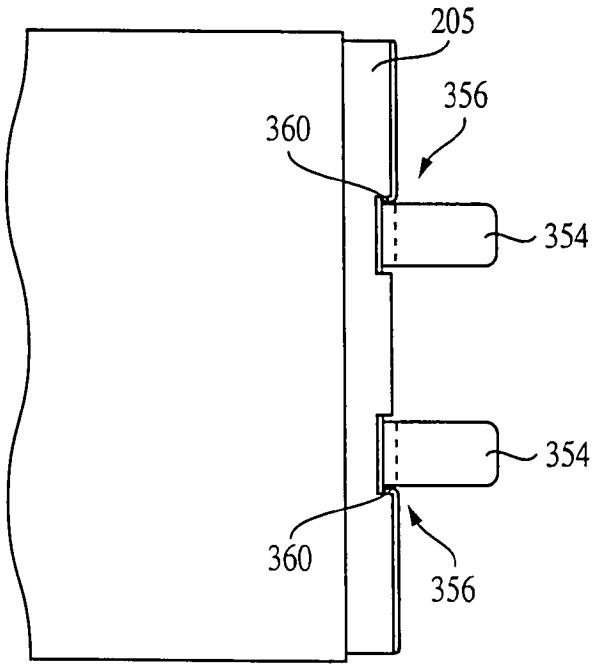
FIGS. 3*c* and 3*d* are end and bottom plan views, respectively, of yet another embodiment of the dual core device of FIGS. 2*a*–2*b*, including terminal slots with tab terminals.
Figure 3C:
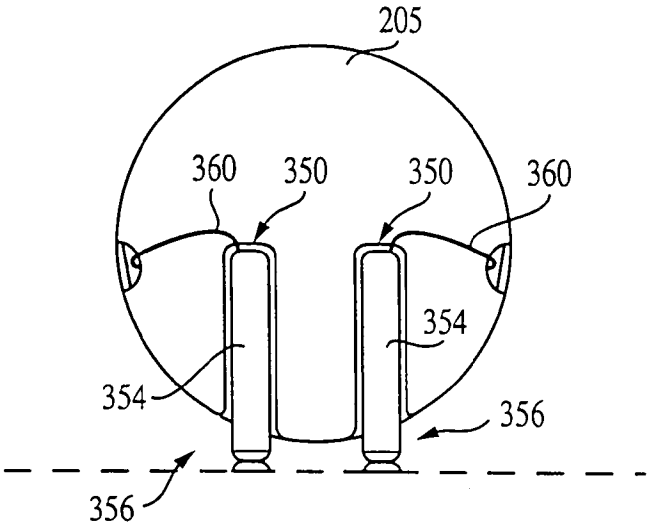
Figure 3E:
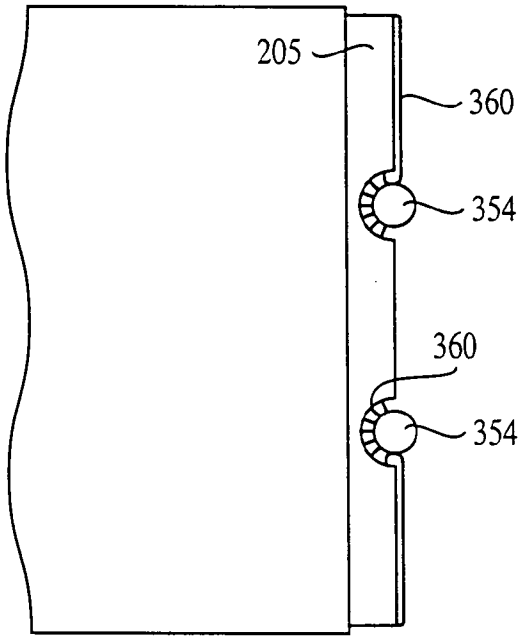
FIG. 3*e* is a bottom plan view of yet another embodiment of the dual core device, utilizing slots with pin terminals.

FIGS. 3*c* and 3*d* illustrate another embodiment of the inductive device 200 of the invention, utilizing a slot and tab arrangement. As shown in FIG. 3*c*, this arrangement comprises a plurality of longitudinal slots 350 formed in the outer side 351 of the first flange 205 of each core 210. A set of corresponding terminal tabs 354 are received within their respective slots 350 and affixed therein, such as by using adhesive or other means. The tabs 354 are shown in FIGS. 3*c*–3*d* to be substantially flat or sheet-like (i.e., thickness <<width), although it will be recognized that this is not an essential element of the invention. Alternatively, for example, the tabs 354 may comprise any number of different cross-sectional forms, even to include pins of circular or square cross-section (FIG. 3*e*). The tabs 354 are, in the illustrated embodiment, deformed at their lower region 356 to form a 90-degree bend so as to allow mating with corresponding terminals/pads on the substrate or device to which the inductive device 200 is mounted. As previously discussed, however, the tabs 354 may also comprise terminals which are adapted to project into corresponding apertures or recesses formed in the substrate (i.e., pin-type mounting).

As shown in FIGS. 3*c*–3*d*, the winding ends 360 are terminated to the tabs 354 by routing the ends 360 into the slots 350, whereby the tabs 354 make electrical contact therewith when the latter are disposed in the slots. The adhesive or other bonding agent maintains the ends of the windings and the tabs 354 in permanent contact without need for wire wrapping, soldering, etc. Alternatively or in addition, however, the ends 360 of the windings may be wrapped around the tabs (as shown with respect to previous embodiments), or even other methods (such as solder bonding) may be employed.

The embodiment of FIGS. 3*c*–3*e* (and variations thereof) advantageously provide for lower cost of manufacturing, since (i) the slots 350 are formed within the cores 210 at time of their formation (thereby obviating a separate drilling or perforation step); (ii) the formation of the tabs 354 and bonding to the core first flanges 205 is a readily existing low-cost technology, and (iii) the laying of the winding ends 360 in the slots obviates manual winding and/or soldering.

Note also that when mounted to a substrate or PCB, the inductive device(s) of the present invention may also optionally be encapsulated using an epoxy or polymer encapsulant (such as silicone) as is well known in the art.

Circuits Utilizing Controlled-Inductance Devices

Referring now to FIGS. 4*a*–5*e*, exemplary isolation transformer, splitter, and filter circuits utilizing the controlled inductance devices previously described herein are disclosed.

Figure 4A:
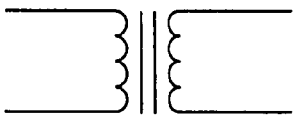
FIGS. 4*a*–4*c* and 4*d*–4*f* are schematic and graphical representations illustrating the use of the controlled leakage inductive device(s) of the present invention in isolation transformer circuits to produce first-order and third-order signal filtering.
Figure 4B:
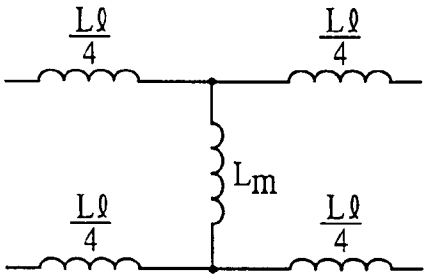
Figure 4C:
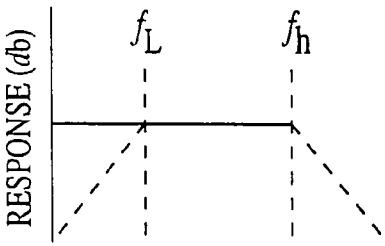
Figure 4D:
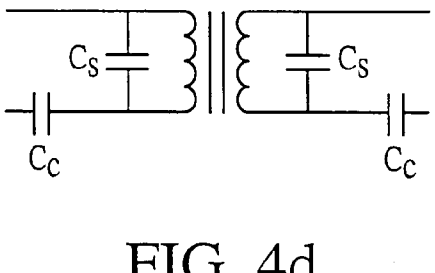

FIGS. 4*a* and 4*d* illustrate typical isolation transformer circuits 400, 430 for first and third order filters, respectively. The addition of the capacitors 432 in the circuit of FIG. 4*d* produces a third order filter.

FIG. 4*b* shows an equivalent circuit 440 to that of FIG. 4*a*. In the circuit of FIG. 4*b*, a total of five inductances ($L_m$ and four inductors of inductance $L_l/4$) are shown. As used herein, $L_m$ comprises the basic low frequency magnetizing inductance of the device, which determines the minimum operating frequency thereof. $L_m$ is equivalent to the differential dual winding inductance. $L_l$ comprises the leakage inductance of the winding, which is the same as the common mode inductance of a dual coil inductor.

FIG. 4*c* illustrates the response of this first-order circuit as a function of frequency. Note that the response decays or rolls off both above and below the mid-band frequencies at approximately 6 db/octave.

Figure 4E:
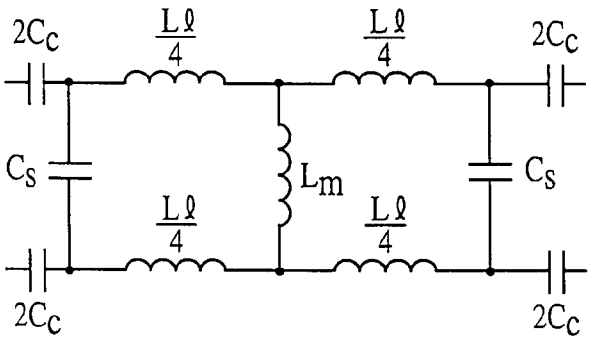
Figure 4F:
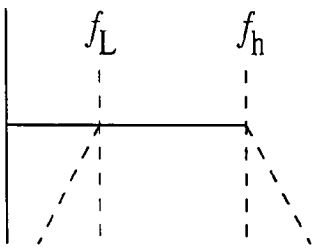

FIG. 4*e* illustrates the equivalent circuit 445 for that of FIG. 4*d*. Note that the response of this third-order circuit (shown in FIG. 4*f*) is different than that of the first-order circuit previously described, with decay in response of approximately 18 db/octave above and below the mid-band frequencies, respectively.

Hence, using the controlled leakage inductive devices of the present invention, an isolation transformer can economically include a low-pass filter in combination with a high-pass filter. These high- and low-pass filter components can also be added independently of one another if desired.

Additionally, it will be recognized that the further addition of inductors in series on each side of the isolation transformer will produce a fifth-order low-pass filter response.

Figure 5A:
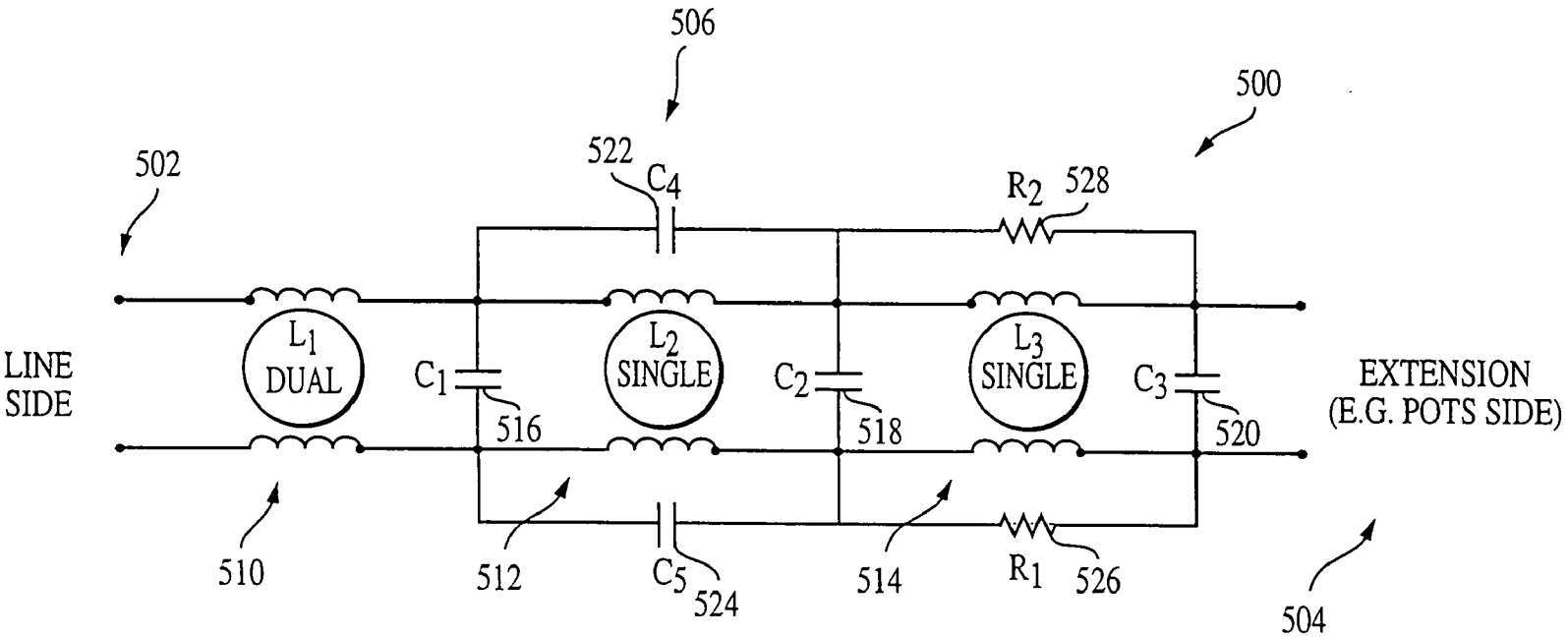
FIG. 5*a* is a schematic diagram illustrating one exemplary embodiment of a telecommunications splitter circuit incorporating the inductive device(s) of the present invention.

Referring now to FIG. 5*a*, an embodiment of a telecommunications splitter circuit 500 that employs the inductive device(s) previously described is schematically illustrated. The splitter circuit 500 advantageously makes use of the single- and dual-core devices discussed above to reduce the cost of the circuit. As shown in FIG. 5*a*, the circuit 500 generally comprises a line side interface 502 and extension device (e.g., POTS) side interface 504, with the splitter components 506 disposed electrically there between. These splitter components 506 comprise a dual-core inductor (L1) 510, first single-core inductor (L2) 512, and second single-core inductor (L3) 514, as well as a plurality of capacitors (C1–C5) 516, 518, 520, 522, 524 and resistors (R1, R2) 526, 528. As shown in FIG. 5*a*, the respective windings of the dual-core inductor 510 are electrically coupled to the line-side interface terminals, and the respective windings of the first single-core inductor 512. The windings of the first single-core inductor 512 are in turn electrically coupled to respective ones of the windings of the second single-core inductor 514, which are in turn electrically coupled to respective ones of the extension (POTS)-side terminals. Bridge capacitors (C1, C2, C3) 516, 518, 520 are electrically interposed between the respective sets of windings of each of the three inductors 510, 512, 514. The remaining two capacitors 522, 524 electrically parallel respective windings of the first single-core inductor 512, while the two resistors (R1, R2) 526, 528 electrically parallel the respective windings of the second single-core inductor 514 and are in series with respective ones of the parallel capacitors 522, 524.

In the splitter circuit 500 of FIG. 5*a*, the dual-core inductor 510 is utilized on the line side to minimize inter-winding capacitance, and to provide high impedance up through the VDSL band. In contrast, the first and second inductors 512, 514 do not affect the line side impedance in the ADSL/VDSL bands, and accordingly may be of the single-core variety. These latter inductors are, in the illustrated embodiment, wound in bifilar fashion, although it will be recognized that other arrangement may be substituted.

On primary advantage of the splitter configuration of FIG. 5*a* is low cost as compared to other prior art configurations. Specifically, the manufacturing cost of the dual core inductor 510 is on the order of \$0.15–0.20 USD, while the cost of each of the single-core inductors 512, 514 is on the order of \$0.08–0.10 USD, thereby making the fabrication of the entire filter circuit 500 extremely cost effective, while maintaining superior signal splitting performance.

Referring now to FIGS. 5*b*–5*e*, improved T1E1-compliant electronic filter circuits utilizing the inductive devices of the present invention are described. While the for lowing circuits are configured to comply with the aforementioned T1E1 Standard, it will be appreciated that these circuits may be adapted to comply with any number of different electrical requirements. Accordingly, the embodiments illustrated in FIGS. 5*a*–5*e* are merely illustrative of the broader concepts of the present invention.

Figure 5B:
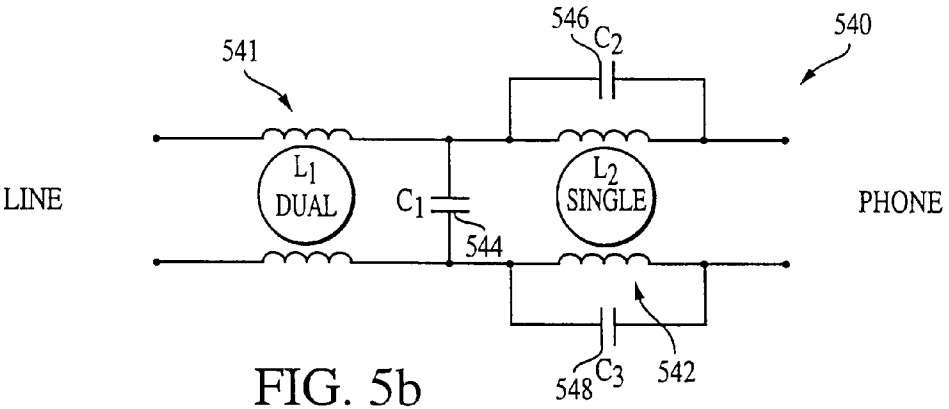
FIG. 5*b* is a schematic of a first embodiment of a telecommunications filter circuit incorporating the single- and dual-core inductive devices of the invention.

As shown in FIG. 5*b*, the first embodiment of the filter circuit 540 generally comprises a line-side dual-core inductor (L1) 541 of the type previously described herein in series with a phone-side single-core inductor (L2) 542. The use of the dual core inductor 541 maintains a high input impedance through 12 MHz on the line side. A blocking capacitor (C1) 544 is disposed electrically between the coupled first and second windings of the line-side and phone-side inductors 541, 542, and two additional capacitors (C2, C3) 546, 548 are disposed in electrical parallel to the respective windings of the phone side (L2) inductor 542.

Figure 5C:
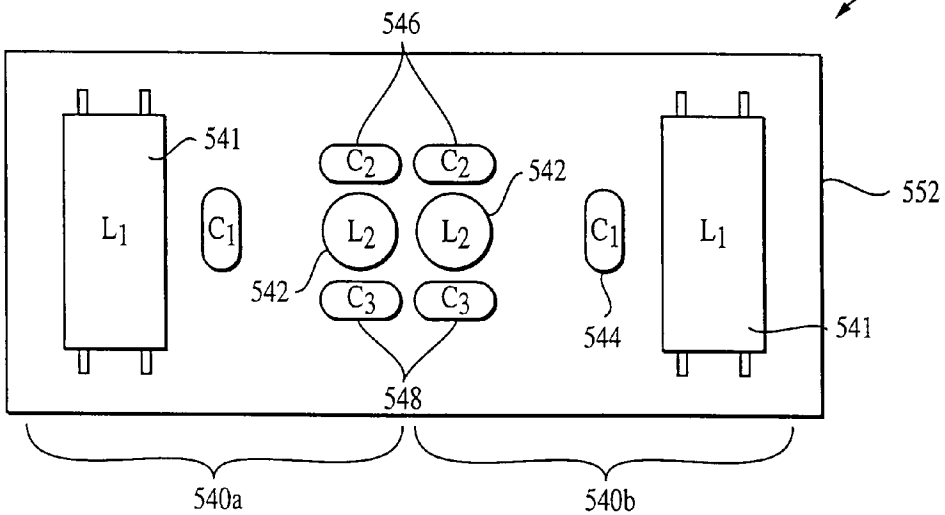
FIG. 5*c* is a top plan view of a dual filter circuit assembly utilizing the filter circuit of FIG. 5*b*.

FIG. 5*c* illustrates the physical layout of a dual-filter circuit board assembly 550 incorporating the filter circuit 540 of FIG. 5*b*. The assembly 550 comprises a circuit board 552 on which the two filter circuits 540*a*, 540*b* are disposed in substantially mirror-image configuration. As is well known in the filter circuit arts, dual filter arrangements characteristically have the problem of cross-talking between the first and second filters; accordingly, a low-cost shielded device is optimal. The assembly 550 of FIG. 5*c* advantageously provides (i) very low manufacturing cost via the use of the low-cost inductive devices previously described herein (e.g., single- and dual-core variants), and (ii) enhanced shielding performance by virtue of the sleeve and L-shaped gap inherent in each of the aforementioned devices used in the assembly 550. It will further be recognized that while the embodiment of FIG. 5*c* illustrates one physical configuration, other layouts can be used due to the fact that the L1 and L2 inductive devices are shielded.

Figure 5D:
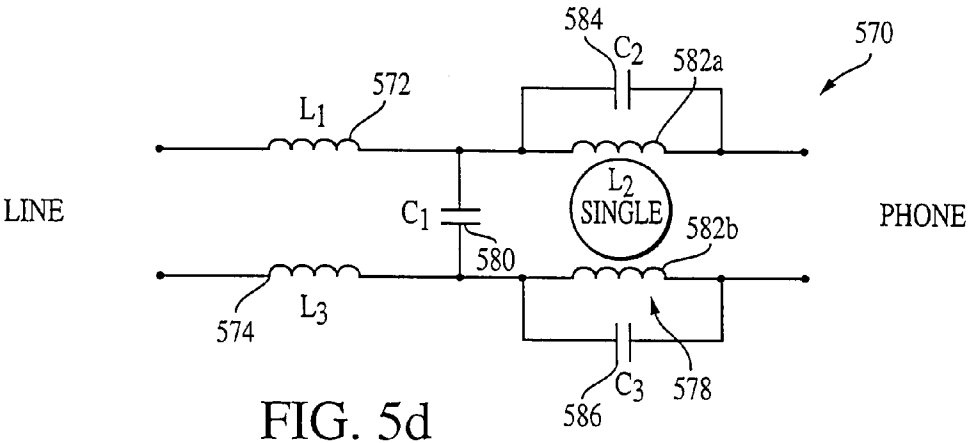
FIG. 5*d* is a schematic of a second embodiment of a telecommunications filter circuit incorporating the single-core inductive device of the invention.

FIG. 5*d* illustrates yet another embodiment of the T1E1 compliant filter circuit of the invention. As shown in FIG. 5*d*, this second embodiment of the circuit 570 comprises two standard (low cost) inductors (L1, L3) 572, 574 in electrical parallel with one another and connected to respective ones of the line side terminals 576. A single-core inductor 578 with two windings is utilized on the phone side of the circuit, the respective windings being connected in electrical series with the windings of the standard inductors 572, 574. A capacitor (C1) 580 is interposed electrically between the three inductors 572, 574, 578 as shown in FIG. 5*d* to act as a high frequency filter. The windings 582*a*, 582*b* of the single-core inductor 578 are bifilar wound onto the core in the illustrated embodiment, since the high-frequency component of the input signal is blocked by the capacitor 580. Additional filter capacitors (C2, C3) 584, 586 are disposed in parallel with the windings 582*a*, 582*b* of the inductor 578 as well.

Figure 5E:
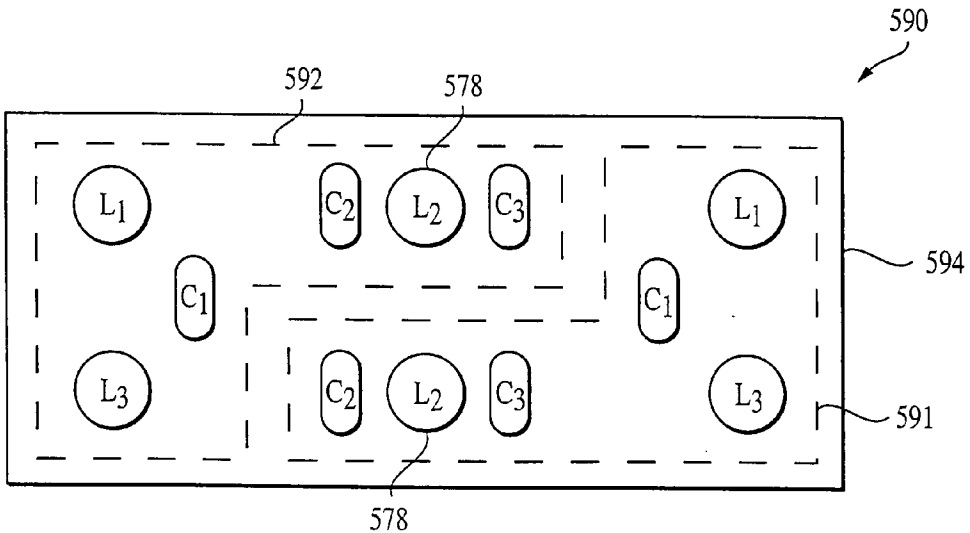
FIG. 5*e* is a top plan view of a dual filter circuit assembly utilizing the filter circuit of FIG. 5*d*.

Referring now to FIG. 5*e*, one embodiment of the physical layout of a dual filter circuit assembly 590 utilizing the filter circuit 570 of FIG. 5*d* is illustrated. In this embodiment, the assembly 590 comprises two filter circuits 591, 592 placed in substantially mirror-image configuration on a substrate 594, such that the single core inductors 578 of each circuit are physically in tandem with each other. Using this configuration, the two single core inductors 578 act to effectively shield the other circuit components disposed on the substrate 594, thereby providing enhanced cross-talk mitigation.

Method of Manufacture

Figure 6A:
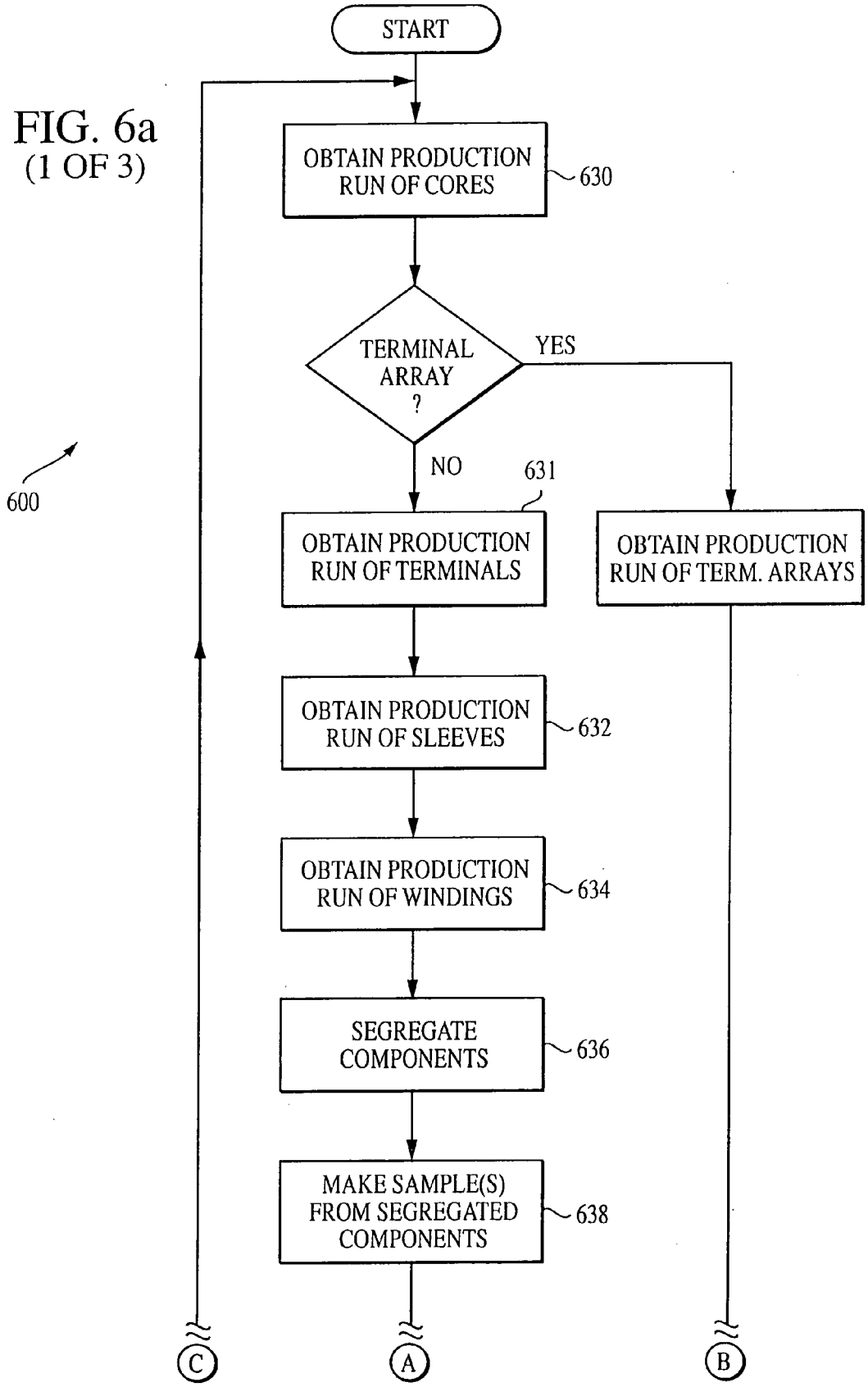
FIG. 6*a* is a logical flow chart illustrating a generalized method of manufacturing the improved inductive device of the present invention.
Figure 6A:
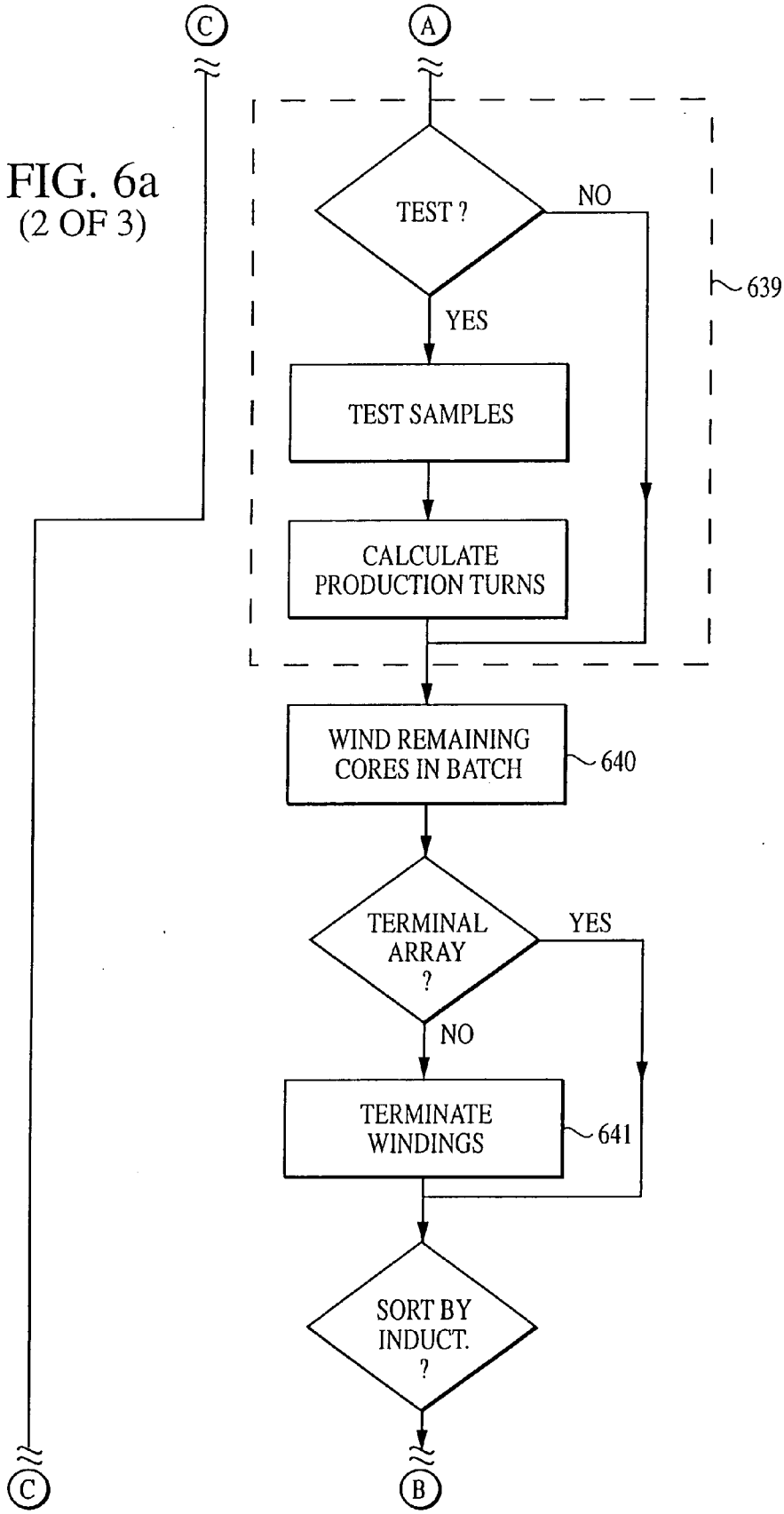
Figure 6A:
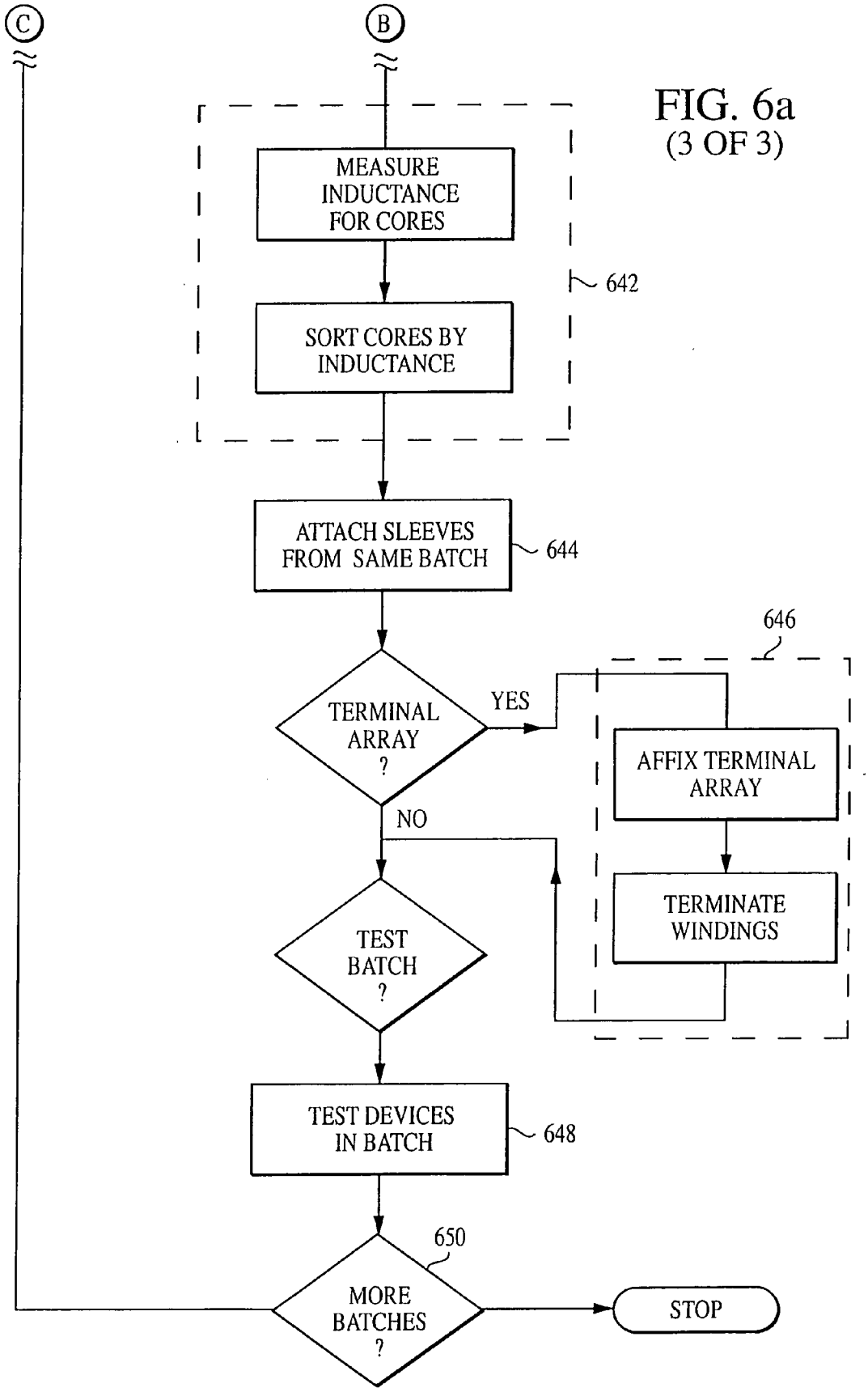

Referring now to FIG. 6*a*, a method 600 for manufacturing the inductive device 200 is illustrated in logical flow diagram form.

It will be recognized that while the following description is cast in terms of a dual drum-core device, the method is generally applicable to the various other configurations and embodiments of inductive device disclosed herein with proper adaptation, such adaptation being within the possession of those of ordinary skill in the electrical device manufacturing field.

In a first step 630 of the method 600, a production run of drum cores is obtained. The production run may be obtained by purchasing the production run from an external entity or can involve fabricating a production run of drum cores. The drum core 210 of the exemplary transformer described above is preferably formed from a magnetically permeable material using any number of well understood processes such as material preparation, pressing, and sintering. The core may be optionally coated with a layer of polymer insulation (e.g., Parylene) or other material, so as to protect the windings from damage or abrasion. This coating may be particularly useful when using very fine gauge windings or windings with very thin film coatings that are easily abraded during the winding process. The core is produced to have specified material-dependent magnetic flux properties, a cross sectional shape, a cross sectional area, a horizontal length, and first and second flange diameters. If a terminal array is not used, then a production run of individual terminals used in conjunction with the core(s) are obtained and deformed per step 631.

In step 632, a production run of sleeves is obtained. The sleeve 230 of the exemplary transformer 200 is preferably formed from a magnetically permeable material using any of the aforementioned processes, or others as applicable. The sleeve also can be optionally coated with a layer of polymer insulation such as Parylene or other material, so that an inadvertent contact to another circuit element would have a lesser effect.

In step 634, a production run of wire (windings) is obtained. The production run may be obtained by purchasing a large contiguous spool of wire from an external entity or can involve fabricating a production run of wire. The wire is preferably copper-based magnet wire as discussed above, although other types of conductors may be used. As previously discussed, the wire can be insulated using any number of insulating coatings if desired. Additionally, where bifilar windings are called for, wire compatible with such applications is selected.

In step 636, the aforementioned components are organized to maintain integrity among production runs or batches. For example, if a production facility maintains stocks of such components, drum cores, sleeves, and wire from different production runs are stored separately. That is, neither the drum cores, sleeves, or wire spools from different production are mixed. Such segregation per step 636 is optional, but is preferred to maintain the integrity of a production run of inductive devices (e.g. transformers 200). Note also that some facilities may optionally maintain integrity among drum cores and sleeves but not wire, or among only drum cores, for example. Other combinations are possible, but maintaining complete production-run integrity of all three components is most desirable. Depending on the particular configuration, it may also be preferable to maintain production-run integrity among electrical terminals, base units 212 and any other components used to fabricate the inductive device.

In step 638, one or more samples of the inductive device are produced. Such sample(s) is/are then tested and modifications are made to bring the sample(s) into specification (step 639). Also, in one embodiment, a nominal turns number, N, is implemented in the sample. A production turns number is computed as N (production)=N (nominal) times the square root of the desired inductance divided by the inductance of the sample, as shown in Eqn. 1:

$$N_R = N_N \times (L_d/L_s)^{1/2} \quad \text{(Eqn. 1)}$$

Where:

$N_R$=Production run turns $L_d$=Desired inductance $L_s$=Sample inductance (average)

$N_N$=Nominal turns

In step 640 of the method, the remaining drum cores of the production batch are wound in accordance with the number of turns determined from the samples of step 638.

In step 641, the wound windings are terminated to the terminals of each core if no terminal array is used. Such termination may be via winding, soldering, and/or any other known method which provides the required degree of electrical continuity.

In step 642, the wound drum cores are optionally sorted by their inductance values. This step involves measuring the inductance of each wound winding, and then sorting them based on the measured inductance. This procedure allows for a higher degree of balance or correspondence between the inductance values of the two wound cores used in the inductive device, thereby enhancing the inductance properties of each individual device. However, it will be recognized that other means other than sorting can be used to match up pairs of windings/cores having similar inductance deviations. Any method used to match measured inductance values of pairs of windings and/or cores in order to at least reduce the standard deviation of device performance criterion about the nominal value falls within the scope of the step 642.

Figure 6B:
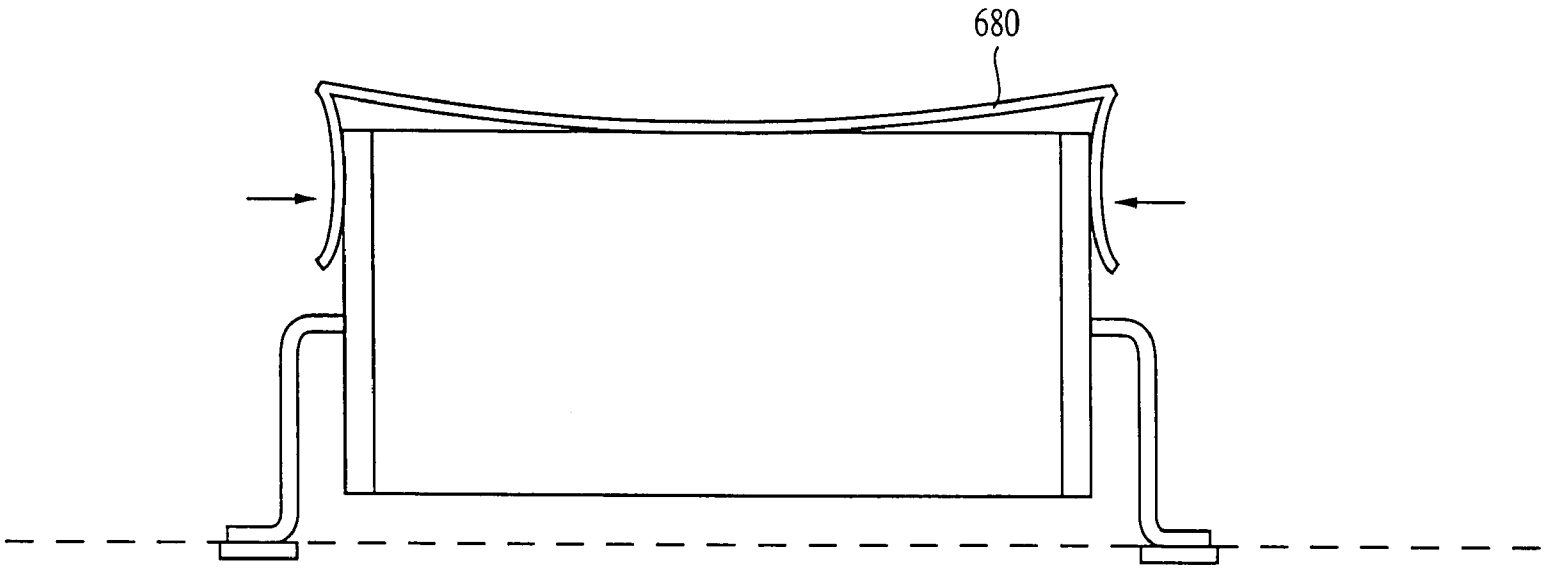
FIG. 6*b* is a side plan view illustrating one exemplary embodiment of the flat spring used to secure the core(s) of the inductive device to the sleeve.

In step 644, the sleeves are affixed to a selected pair of primary and secondary windings and their associated cores for the selected batch being manufactured. The sleeve is preferably affixed so as to minimize the right angle (L-shaped) air gap 245. This air gap is preferably made to be as close to zero as possible. Several methods can be used to affix the sleeve to the pair of drum cores. For example, the drum cores can be held into the sleeve by either gluing, using a formed wire or a flat spring. FIG. 6*b* illustrates an exemplary use of the aforementioned flat spring 680 to maintain the cores in place with respect to the sleeve.

In step 646 of the method 600, the sleeved pair of cores of the batch being manufactured may optionally be affixed to the base 212 or bases in some embodiments. Also, the wire used in the windings is connected to the appropriate terminals, e.g., 215*a* and 215*b*. The base itself is either manufactured as a part of this step, or is acquired from a third party. A set of bases used in a production run or batch of devices should also be consistent, but electrically affect transfer function and leakage inductance to a much lesser degree than the other components in the device.

In step 648, the devices 200 are optionally tested to insure they meet both the signal path transfer function requirements and/or the leakage inductance requirement. In some embodiments of the method, statistical sampling or statistical process control (SPC) may be performed by testing a statistically significant subset of the produced set of transformers to at least determine that the transformers meet specifications to within a statistical set of quality assurance specifications. Anecdotal sampling or other techniques may also be employed.

Lastly, when all of the devices for the present batch have been assembled (and tested if desired), the process is repeated for the next batch of devices per step 650.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. For example, while the invention has been disclosed in terms of a component for telecommunications and networking applications, the inductive device architecture of the present invention could be used in other applications such as specialized power transformers. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An inductive device, comprising:

at least one core, at least a portion of said at least one core comprising a magnetically permeable material;

a first conductive winding pair having a plurality of turns, at least a portion of said first winding pair being disposed around said at least one core;

a second conductive winding pair having a plurality of turns, at least a portion of said second winding being disposed around said at least one core and proximate to said first conductive winding pair; and a sleeve, at least a portion of said sleeve comprising a magnetically permeable material, whereby said sleeve is fitted over at least a portion of said at least one core;

wherein said sleeve and said at least one core cooperatively form predetermined end gap when assembled, said end gap being adapted to control the differential inductance of said device; and wherein said sleeve and said at least one core further cooperatively form a predetermined side gap when assembled, said side gap being adapted to control the common mode inductance of said device;

wherein said end gap is orthogonal in orientation with respect to said side gap.

2. The device of claim 1, wherein said first and second winding sets comprise bifilar wound pairs of individual conductors.

3. An inductive device, comprising:

a magnetically permeable core element having a base with a stepped periphery and a substantially cylindrical center member;

a winding element having a plurality of conductive terminals and an aperture, said aperture being adapted to receive at least a portion of said center member;

at least one winding wound substantially around said winding element, the ends of said at least one winding being electrically communicating with respective ones of said terminals; and a magnetically permeable cap element having a recess formed therein, said recess being adapted to receive at least a portion of said core element, winding element, and winding therein, the proximity between said center member and an interior surface of said recess producing a first controlled gap within said device;

wherein said center member, cap element, and stepped periphery substantially determine said proximity.

4. The device of claim 3, wherein said base further comprises a plurality of recesses formed therein, said recesses adapted to receive corresponding portions of said winding element, said corresponding portions also retaining at least a portion of respective ones of said terminals.

5. The device of claim 3, wherein said winding element comprises a bobbin formed primarily from a polymeric material.

6. The device of claim 5, wherein said bobbin comprises a spool-like structure having said aperture disposed along a central axis thereof.

7. The device of claim 3, wherein said device is adapted to be mounted to a parent device in a substantially vertical orientation.

8. The device of claim 7, wherein said terminals are adapted for through-hole mounting to a parent PCB.

9. The device of claim 7, wherein said terminals are adapted for surface-mounting to a parent PCB.

10. The device of claim 3, wherein said winding element comprises a plurality of terminal-receiving elements formed thereon, said terminal receiving elements being adapted to:

receive respective ones of said terminals; and cooperate with corresponding recesses of said base of said core element in order to maintain said winding element in rotational alignment with said core element.

11. The device of claim 10, wherein said first and second gaps are configured to provide at least one of a controlled differential and leakage inductance.

12. An inductive device, comprising:

a magnetically permeable core element having a base with a peripheral step formed thereon, and a substantially cylindrical center member;

a winding element having a plurality of conductive terminals and an aperture, said aperture being adapted to receive at least a portion of said center member;

at least one winding wound substantially around said winding element, the ends of said at least one winding being electrically communicating with respective ones of said terminals; and a magnetically permeable cap element having a recess formed therein, said recess being adapted to receive at least a portion of said core element, winding element, and winding therein;

wherein said peripheral step, center member, and cap element are configured to produce a predetermined L-shaped controlled width gap formed between plurality of interior surfaces of said cap element and a plurality of surfaces of said center member.

13. The device of claim 12, wherein a second controlled width gap is formed between a lower portion of said cap element and said base of said core element.

14. An inductive device, comprising:

a magnetically permeable core element having a base with a peripheral step formed thereon, and a substantially cylindrical center member;

a winding element having a plurality of conductive terminals and an aperture, said aperture being adapted to receive at least a portion of said center member;

at least one winding wound substantially around said winding element, the ends of said at least one winding being electrically communicating with respective ones of said terminals; and a magnetically permeable cap element having a recess formed therein, said recess being adapted to receive at least a portion of said core element, winding element, and winding therein;

wherein said peripheral step, center member, and cap element are configured to produce a predetermined controlled width gap formed between an interior surface of said cap element and a top surface of said center member.

15. A surface-mount inductive device, comprising: a magnetically permeable core element having a base and a substantially cylindrical center member;

a winding element having a plurality of conductive terminals and an aperture, said aperture being adapted to receive at least a portion of said center member, said terminals being adapted for surface mounting to an external device;

at least one winding wound substantially around said winding element, the ends of said at least one winding being electrically communicating with respective ones of said terminals; and a magnetically permeable cap element having a recess formed therein, said recess being adapted to receive at least a portion of said core element, winding element, and winding therein, said center member and an interior surface of said recess producing a first predetermined controlled gap within said device;

wherein said base further comprises a peripheral step, and said peripheral step, said center member, and said cap element are configured to control the width of said first predetermined gap.

16. The device of claim 15, wherein said base comprises a plurality or peripheral recesses, and said winding element comprises a plurality of terminal-receiving elements formed on a surface thereof, said terminal receiving elements being adapted to receive respective ones of said conductive terminals, and cooperate with said peripheral recesses of said base in order to align said winding element with said core element.

17. An inductive device, comprising:

a magnetically permeable core element having a base with a stepped periphery and a substantially cylindrical center member;

a winding element having a plurality of conductive terminals and an aperture, said aperture being adapted to receive at least a portion of said center member;

at least one winding wound substantially around said winding element, the ends of said at least one winding being electrically communicating with respective ones of said terminals; and a magnetically permeable cap element having a recess formed therein, said recess being adapted to receive at least a portion of said core element, winding element, and winding therein, the proximity between said center member and an interior surface of said recess producing a first L-shaped controlled gap within said device, said gap filled with a dielectric material;

wherein said center member, cap element, and stepped periphery cooperate to set said proximity to a predetermined distance, said predetermined distance providing a desired inductive characteristic.

18. The device of claim 17, wherein said dielectric material comprises air.

19. The device of claim 17, wherein said winding element comprises a bobbin formed primarily from a polymeric material and said plurality of conductive terminals are adapted for surface-mounting the inductive device on a substrate.

20. The device of claim 19, wherein said inductive device further comprises at least two windings separated by an isolating material.

21. The device of claim 17, wherein said isolating material comprises polymer tape.

22. The device of claim 21, wherein said device is adapted to be mounted to a parent device in a substantially vertical orientation.

23. The device of claim 21, wherein said terminals are adapted for through-hole mounting to a parent PCB.

24. The device of claim 17, wherein said dielectric material comprises a polymer.

25. An inductive device, comprising:

a magnetically permeable core element having a base with a peripheral ridge, and a substantially vertical center member;

a winding element having an aperture, said winding element having at least one multi-filar conductor and said aperture being adapted to receive at least a portion of said center member;

a plurality of conductive terminals adapted for electrical mating to an external device;

at least one winding wound substantially around said winding element, the ends of said at least one winding electrically communicating with respective ones of said terminals; and a magnetically permeable sleeve element having a recess formed therein, said recess being adapted to mate with said peripheral ridge of said base to form a first predetermined gap, and to receive at least a portion of said core element, winding element, and winding therein, the center member and an interior surface of said recess forming a second predetermined gap, said first and second gaps being oriented orthogonally with respect to on another, said first and second gaps further being configured to control the electrical characteristics of said device.

26. An inductive device, comprising:

a magnetically permeable core element having a base with a peripheral step formed thereon, and a substantially cylindrical center member;

a winding element comprising a polymer material, said winding element further having a plurality of conductive terminals and an aperture, said aperture being adapted to receive at least a portion of said center member;

at least one winding wound substantially around said winding element, the ends of said at least one winding electrically communicating with respective ones of said terminals; and a magnetically permeable cap element having a recess formed therein, said recess being adapted to receive at least a portion of said core element, winding element, and winding therein;

wherein said peripheral step, center member, and cap element are configured to produce a predetermined L-shaped, controlled-width gap formed between a plurality of interior surfaces of said cap element and a plurality of surfaces of said center member.

27. The device of claim 26, wherein a second controlled width gap is formed between a lower portion of said cap element and said base of said core element.

28. An inductive device, comprising:

a magnetically permeable core element having a base with a peripheral step formed thereon, and a substantially cylindrical center member;

a winding element having a plurality of conductive terminals and an aperture, said aperture being adapted to receive at least a portion of said center member;

at least one winding wound substantially around said winding element, the ends of said at least one winding being electrically communicating with respective ones of said terminals; and a magnetically permeable cap element having a recess formed therein, said recess being adapted to receive at least a portion of said core element, winding element, and winding therein;

wherein said peripheral step, center member, and cap element are configured to produce a fixed predetermined controlled-width gap, said gap formed between an interior surface of said cap element and a top surface of said center member.

* * * * *